US010875332B2

(12) United States Patent
Kii

(10) Patent No.: US 10,875,332 B2
(45) Date of Patent: Dec. 29, 2020

(54) RECORDING DEVICE

(71) Applicant: SEIKO EPSON CORPORATION, Tokyo (JP)

(72) Inventor: Soichiro Kii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/511,874

(22) Filed: Jul. 15, 2019

(65) Prior Publication Data

US 2020/0023659 A1 Jan. 23, 2020

(30) Foreign Application Priority Data

Jul. 17, 2018 (JP) ..... 2018-134196

(51) Int. Cl.
*B41J 1/22* (2006.01)
*B41J 29/17* (2006.01)

(52) U.S. Cl.
CPC ..... *B41J 29/17* (2013.01)

(58) Field of Classification Search
None
See application file for complete search history.

(56) References Cited

U.S. PATENT DOCUMENTS 5,636,929 A * 6/1997 Asano ..... B41J 13/076 347/104
6,736,560 B2 * 5/2004 Nemoto ..... B41J 3/60 347/104
8,998,205 B2 * 4/2015 Nakahata ..... B65H 5/068 271/264
2014/0292976 A1 10/2014 Ohashi et al.
2016/0376456 A1 12/2016 Yamazaki

FOREIGN PATENT DOCUMENTS

| | | |
|---|---|---|
| JP | 2006-273449 | 10/2006 |
| JP | 4937042 | 5/2012 |
| JP | 2012-240813 | 12/2012 |
| JP | 2014-117908 | 6/2014 |
| JP | 2017-008273 | 1/2017 |
| JP | 6237981 | 11/2017 |

* cited by examiner

*Primary Examiner* — Alejandro Valencia
(74) *Attorney, Agent, or Firm* — Workman Nydegger

(57) ABSTRACT

A recording device includes a recording unit; an inverting path that inverts a medium that recording has been performed on and sends the medium back to the recording unit; a feeding roller an outer circumferential surface of which is in contact with the medium at both a first position in the inverting path before inverting the medium and a second position in the inverting path after inverting the medium; and a cleaning unit that cleans the outer circumferential surface of the feeding roller; in which the cleaning unit, before a contact portion on the outer circumferential surface of the feeding roller in contact with the medium at the first position reaches the second position with rotation of the feeding roller, is disposed at a position in contact with the contact portion.

11 Claims, 19 Drawing Sheets

RECORDING DEVICE

The present application is based on and claims priority from JP Application Serial Number 2018-134196, filed Jul. 17, 2018, the disclosure of which is hereby incorporated by reference herein in its entirety.

BACKGROUND

1. Technical Field

The present disclosure relates to a recording device.

2. Related Art

To date, in a recording device, double-sided recording is performed in which, not only is recording performed on a surface of a medium, but after recording has been performed on the surface, recording is performed also on the rear surface after inverting the front and rear surfaces of the medium. For example, as illustrated in JP-A-2006-273449, a recording device capable of performing double-sided recording includes an inverting roller that inverts the front and rear surfaces of the medium after recording has been performed on the front surface by a recording unit.

An ink jet printer, which is an example of a recording device described in JP-A-2006-273449, includes a first inverting roller denoted by reference sign 108 and a second inverting roller denoted by reference sign 109 in FIG. 13 of JP-A-2006-273449. The first inverting roller is a roller that inverts a medium and the second inverting roller is in contact with the medium before being inverted by the first inverting roller and the medium after being inverted by the first inverting roller.

In this configuration, for example, ink is ejected from a recording head toward a first surface of the medium, and after recording has been performed, since the first surface is in contact with the second inverting roller, the ink on the first surface might adhere to the second inverting roller.

Then, when the medium is inverted by the first inverting roller and comes into contact with the second inverting roller again, there is a risk that the ink attached to the second inverting roller may adhere to the medium after the inversion and the first surface may become soiled.

SUMMARY

The present disclosure is a recording device that includes a recording unit that records on a medium; an inverting path that inverts the medium sent from the recording unit and that sends the inverted medium back to the recording unit; a feeding roller an outer circumferential surface of which applies a transporting force to the medium both at a first position in the inverting path before inverting the medium and at a second position in the inverting path after inverting the medium; and a cleaning unit that cleans the outer circumferential surface of the feeding roller by coming into contact with the outer circumferential surface of the feeding roller; in which the cleaning unit, before a contact portion on the outer circumferential surface of the feeding roller in contact with the medium at the first position reaches the second position with rotation of the feeding roller, is disposed at a position in contact with the contact portion.

DESCRIPTION OF EXEMPLARY EMBODIMENTS

Figure 1:
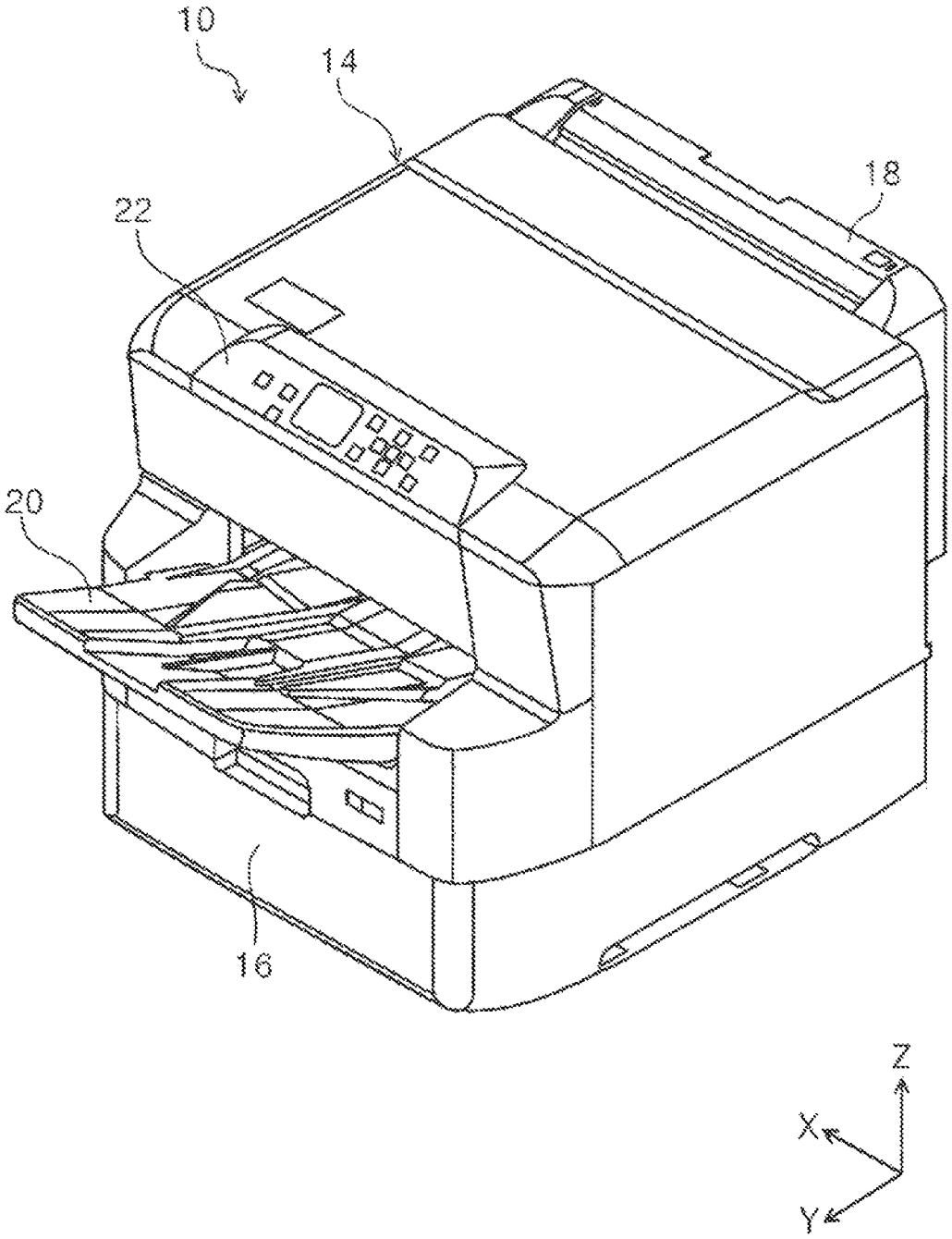
FIG. 1 is an external perspective view of a recording device according to a first embodiment of the present disclosure.

Hereinafter, the present disclosure will be schematically described.

A recording device according to a first aspect of the present disclosure includes a recording unit that records on a medium; an inverting path that inverts the medium sent from the recording unit and sends the inverted medium back to the recording unit; a feeding roller an outer circumferential surface of which applies a transporting force to the medium both at a first position in the inverting path before inverting the medium and at a second position in the inverting path after inverting the medium; and a cleaning unit that cleans the outer circumferential surface of the feeding roller by coming into contact with the outer circumferential surface of the feeding roller; in which the cleaning unit, before a contact portion on the outer circumferential surface of the feeding roller in contact with the medium at the first position reaches the second position with rotation of the feeding roller, is disposed at a position in contact with the contact portion.

According to this aspect, even if the feeding roller is soiled by the medium on which recording has been performed at the first position, the cleaning unit can clean the feeding roller before the medium contacts the feeding roller again at the second position. As a result, it is possible to suppress adhesion of dirt on the feeding roller to the medium after the inversion.

That is, this aspect does not simply provide a cleaning unit that cleans the feeding roller, the cleaning unit has a feature in that, before a contact portion in contact with the medium at the first position on the outer circumferential surface of the feeding roller reaches the second position with rotation of the feeding roller, the cleaning unit is provided at a position that is in contact with the contact portion.

In the recording device according to a second aspect of the present disclosure, in the first aspect, the cleaning unit is provided in a region along the outer circumferential surface of the feeding roller and is in contact with the contact portion between an intermediate position, which is between the first position and the second position, and the first position.

In this aspect, since the cleaning unit is in contact with the contact portion between the intermediate position, which is between the first position and the second position, and the first position, the outer circumferential surface of the feeding roller can be cleaned at a position close to the first position. Therefore, if the dirt adhering to the outer circumferential surface of the feeding roller is, for example, a liquid such as ink, the viscosity of the liquid increases with time and it becomes difficult to clean, but, at a position near the first position, cleaning can be performed before the viscosity of the liquid increases to ensure removal of the dirt.

In the recording device according to a third aspect of the present disclosure, in the first aspect or the second aspect, the cleaning unit is pressed against the outer circumferential surface of the feeding roller by a pressing member.

In this aspect, since the cleaning unit is pressed against the outer circumferential surface of the feeding roller by the pressing member, it is possible to improve the ability of the cleaning unit to remove the dirt attached to the feeding roller.

In the recording device according to a fourth aspect of the present disclosure, in any one of the first to third aspects, the inverting path includes an inverting roller that inverts the medium, to which a transporting force is applied by the feeding roller at the first position, toward the second position, and the cleaning unit, when a medium transport path is seen in side view, is disposed in a space between the feeding roller and the inverting roller.

According to this aspect, when the medium transport path is seen in side view, because the cleaning unit is disposed in the space between the feeding roller and the inverting roller, the space between the feeding roller and the inverting roller in the inverting path can be used effectively and an increase in the size of the inverting path can be suppressed.

In the recording device according to a fifth aspect of the present disclosure, in the fourth aspect, the cleaning unit, when the medium transport path is seen in side view, is disposed in a space between a first tangential line, which is a common tangential line between a position on the outer circumferential surface of the feeding roller facing the first position and an outer circumferential surface of the inverting roller, and a second tangential line, which is a common tangential line between a position on the outer circumferential surface of the feeding roller facing the second position and the outer circumferential surface of the inverting roller.

According to this aspect, since the cleaning unit is disposed in the space between the first tangential line and the second tangential line, the cleaning unit is not disposed outside the first tangential line and the second tangential line, the path of the inverting path between the feeding roller and the inverting roller can be disposed along the first tangential line and the second tangential line and the length of the inverting path can be decreased. As a result, it is possible to improve the throughput for the inverting path.

In the recording device according to a sixth aspect of the present disclosure, in the fourth aspect or the fifth aspect, the cleaning unit is a first cleaning unit, and in addition to the first cleaning unit, a second cleaning unit that cleans the outer circumferential surface of the inverting roller is provided.

In this aspect, in addition to cleaning the outer circumferential surface of the feeding roller by the first cleaning unit, since the outer circumferential surface of the inverting roller is cleaned by the second cleaning unit, adhesion of dirt to the medium can be suppressed in the inverting path.

In the recording device according to a seventh aspect of the present disclosure, in the sixth aspect, when the medium transport path is seen in side view, with respect to an imaginary line connecting a rotation center of the feeding roller and a rotation center of the inverting roller, the first cleaning unit is disposed on a first side of the imaginary line, and the second cleaning unit is disposed on a second side opposite to the first side across the imaginary line.

In this aspect, when the medium transport path is seen in side view, with respect to the imaginary line connecting the rotation center of the feeding roller and the rotation center of the inverting roller, because the first cleaning unit is disposed on the first side of the imaginary line and the second cleaning unit is disposed on the second side opposite to the first side across the imaginary line, it is possible to avoid a situation where the first cleaning unit and the second cleaning unit are collectively disposed on the first side or the second side with respect to the imaginary line, and the space in the inverting path can be used more effectively.

In the recording device according to an eighth aspect of the present disclosure, in the seventh aspect, the first side is a side of the inverting path before inverting the medium.

In this aspect, it is possible to obtain the same effects as those described above.

In the recording device according to a ninth aspect of the present disclosure, in the fourth aspect or the fifth aspect, the cleaning unit is in contact with the outer circumferential surface of the inverting roller in addition to the outer circumferential surface of the feeding roller and cleans the outer circumferential surface of the inverting roller.

In this aspect, because the cleaning unit is in contact with the outer circumferential surface of the inverting roller in addition to the outer circumferential surface of the feeding roller and cleans the outer circumferential surface of the inverting roller, two rollers can be cleaned with a single cleaning unit and the construction of the device can be simplified.

In the recording device according to a tenth aspect of the present disclosure, in the ninth aspect, the cleaning unit is configured to be displaced in directions in which the cleaning unit comes in and out of contact with the feeding roller and the inverting roller.

In this aspect, since the cleaning unit is configured to be displaced in directions in which the cleaning unit comes in and out of contact with the feeding roller and the inverting roller, the position of the cleaning unit with respect to the feeding roller and the inverting roller can be adjusted. For example, the position of the cleaning unit can be adjusted even if the size of the cleaning unit is changed due to aging or wear. As a result, the cleaning performance of the cleaning unit for the feeding roller and the inverting roller can be maintained.

In the recording device according to an eleventh aspect of the present disclosure, in the tenth aspect, the cleaning unit, when the medium transport path is seen in side view, with respect to an imaginary line connecting a rotation center of the feeding roller and a rotation center of the inverting roller, is disposed on a side of the inverting path after inverting the medium.

In this aspect, for example, when the inverting path after inverting the medium is on an upper side in the device height direction, the cleaning unit can adjust its position with respect to the feeding roller and the inverting roller by the dead weight of the cleaning unit. As a result, the cleaning performance of the cleaning unit can be maintained with a simple configuration.

In the recording device according to a twelfth aspect of the present disclosure, in the tenth aspect, the cleaning unit, when the medium transport path is seen in side view, with respect to an imaginary line connecting a rotation center of the feeding roller and a rotation center of the inverting roller, is disposed on a side of the inverting path before inverting the medium.

In this aspect, it is possible to obtain the same effects as those described above.

In the recording device according to a thirteenth aspect of the present disclosure, in any one of the fourth to twelfth aspects, the feeding roller, the inverting roller, and the cleaning unit constitute a unit body configured to attach to and detach from a casing including the recording unit.

In this aspect, because the feeding roller, the inverting roller, and the cleaning unit constitute a unit body that is configured to attach to and detach from the casing provided with the recording unit, when maintaining the cleaning unit, an operation can be performed in a state in which the unit body is removed from the casing. Here, when the feeding roller, the inverting roller, and the cleaning unit are disposed in the casing without forming the unit body, it is necessary to perform maintenance work deep within the casing, which is inferior in workability. Therefore, the maintainability of the cleaning unit can be improved.

In the recording device according to a fourteenth aspect of the present disclosure, in any one of the first to thirteenth aspects, the cleaning unit is a roller member.

In this case, since the cleaning unit is a roller member, it is possible to change a portion of the outer circumferential surface of the inverting roller in contact with the cleaning unit with rotation of the cleaning unit. Thereby, the cleaning performance of the cleaning unit can be maintained.

In the recording device according to a fifteenth aspect of the present disclosure, in any one of the first to ninth and thirteenth aspects, the cleaning unit is a belt-like member.

In this aspect, since the cleaning unit is a belt-like member, and the portion in contact with the roller to be cleaned changes, a decrease in the cleaning performance can be suppressed, and the lifetime of the cleaning means can be extended.

Hereinafter, the present disclosure will be specifically described.

First Embodiment (FIGS. 1 to 10)

First, a printer 10 (recording device) according to the first embodiment of the present disclosure will be described with reference to FIGS. 1 to 10.

Furthermore, in each of FIGS. 1 to 19, the Z-axis direction is the vertical direction, which is the height direction of the device. The X-axis direction and the Y-axis direction are directions along the horizontal plane, the X-axis direction is the device width direction, and the Y-axis direction is the device depth direction. From the viewpoint of transporting a medium represented by a recording sheet, the medium transport direction when recording on the medium is a direction along the Y-axis direction, and the X-axis direction is the medium width direction.

In FIG. 1, the printer 10 includes a casing 14 provided with a recording head 12 (refer to FIG. 3) as a "recording unit". In a device lower portion of the casing 14, a medium storage unit 16 that supplies the medium toward the recording head 12 is provided. A medium feeding unit 18 that feeds the medium toward the recording head 12 is provided on a device-rear-surface side of the casing 14. On a device-front-surface side of the casing 14, a discharge stacker 20 that protrudes from the casing 14 to the device front side is provided. An operation unit 22 for operating the printer 10 is provided at a device-front-side upper portion of the casing 14, specifically, above the discharge stacker 20.

Medium Transport Path

The medium transport path in the printer 10 will be described with reference to FIGS. 2 to 4. The printer 10 includes a medium transport path 24 (FIG. 3), a medium feeding path 26 (FIG. 3), and an inverting path 28 (FIG. 4).

Figure 2:
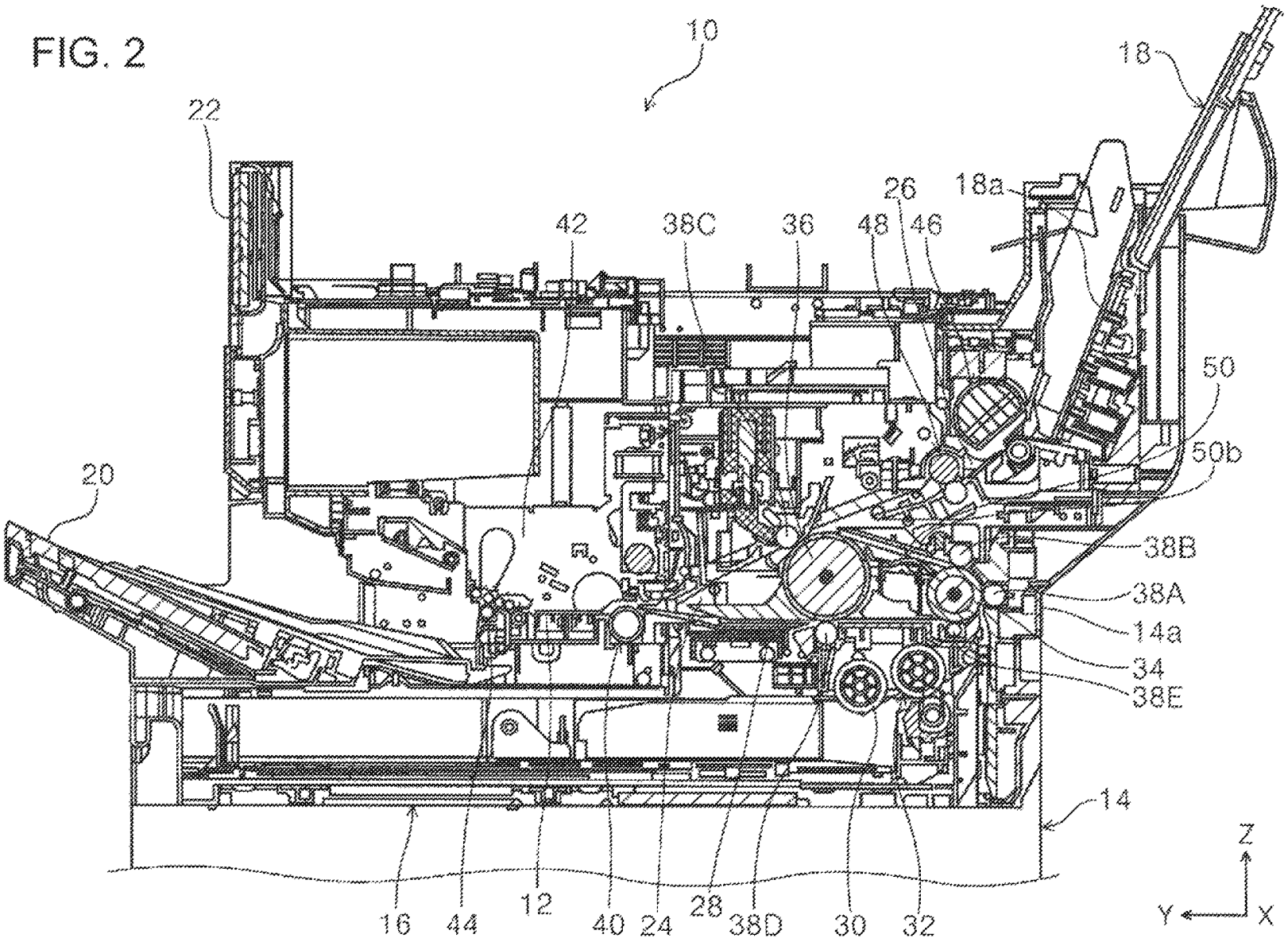
FIG. 2 is a side sectional view illustrating a medium transport path in the recording device according to the first embodiment of the present disclosure.
Figure 3:
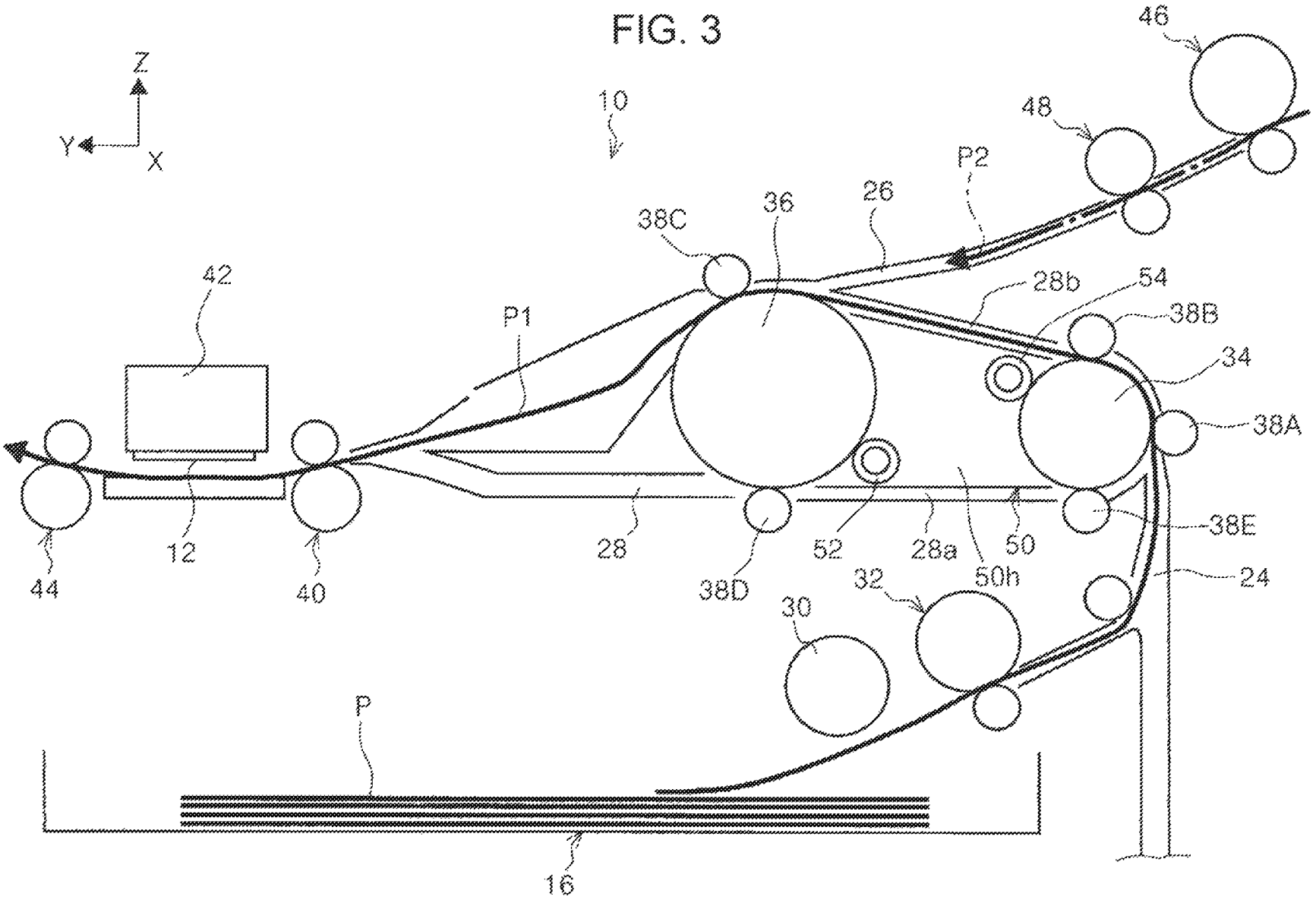
FIG. 3 is a sectional view illustrating a path of a medium that is sent from a medium storage unit to a recording head in the medium transport path in the present disclosure.
Figure 4:
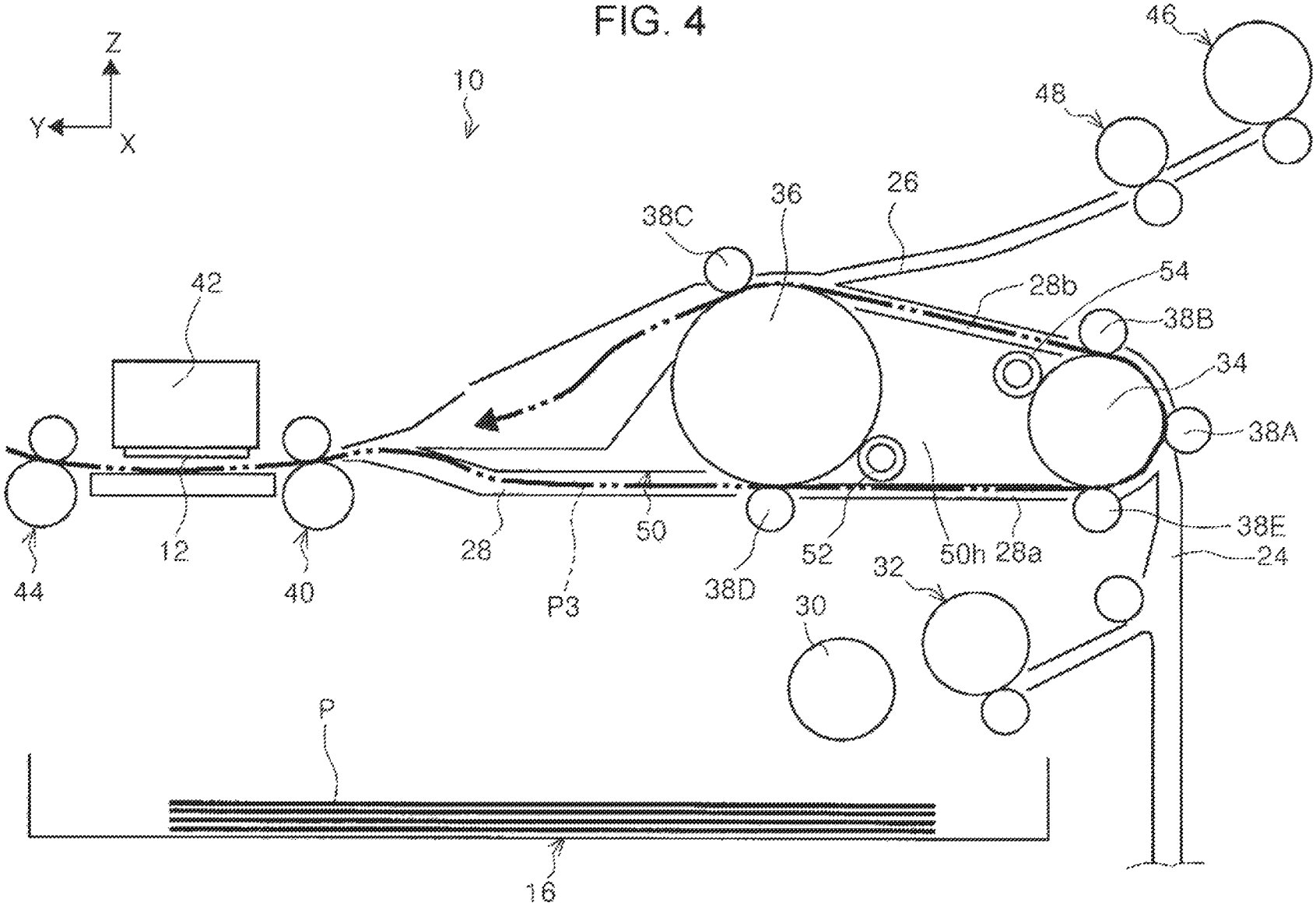
FIG. 4 is a sectional view illustrating a path of the medium that goes from the recording head to an inverting path and then back again to the recording head in the medium transport path in the present disclosure.

Among them, the medium transport path 24 is configured as a path that enables discharge from the medium storage unit 16 toward the discharge stacker 20 through the area facing the recording head 12 (FIGS. 2 to 4).

A medium P stored in the medium storage unit 16 is sent downstream along the medium transport path 24 by a feeding roller 30 and a transport roller pair 32. An inverting roller 34 is provided downstream of the transport roller pair 32 in the medium transport path 24. A feeding roller 36 is provided on the front side in the device depth direction at a distance from the inverting roller 34. In the present embodiment, a diameter of the inverting roller 34 is set to be smaller than a diameter of the feeding roller 36.

A first driven roller 38A, a second driven roller 38B, and a fifth driven roller 38E that are driven to rotate with respect to the inverting roller 34 are disposed around the inverting roller 34. A third driven roller 38C and a fourth driven roller 38D that are driven to rotate with respect to the feeding roller 36 are disposed around the feeding roller 36.

The medium P sent downstream in the transport direction by the transport roller pair 32 is sequentially nipped by the inverting roller 34 and the first driven roller 38A, the inverting roller 34 and the second driven roller 38B, and the feeding roller 36 and the third driven roller 38C, and is fed downstream in the transport direction.

A transport roller pair 40 is provided downstream of the feeding roller 36 in the medium transport path 24 in the transport direction. A carriage 42 provided with the recording head 12 is disposed downstream of the transport roller pair 40. In the present embodiment, the carriage 42 is configured to reciprocate in the X-axis direction. The recording head 12 is disposed on a lower portion of the carriage 42 and is configured to discharge ink, which is an example of a liquid, toward the −Z direction side.

A discharge roller pair 44 is disposed downstream of the carriage 42 in the transport direction. The discharge roller pair 44 discharges the medium P that has been recorded on by the recording head 12 toward the discharge stacker 20. The thick line denoted by the reference sign P1 in FIG. 3 indicates the transport path of the medium P transported along the medium transport path 24.

Next, the medium feeding path 26 will be described with reference to FIGS. 2 to 4. As illustrated in FIG. 2, the medium feeding unit 18 includes a mounting surface 18*a* on which the medium P can be mounted in an inclined posture. The medium feeding path 26 includes a first feeding roller pair 46 and a second feeding roller pair 48 disposed downstream of the first feeding roller pair 46. The medium supplied to the medium feeding unit 18 from the mounting surface 18*a* of the medium feeding unit 18 (FIG. 2) is sequentially nipped by the first feeding roller pair 46 and the second feeding roller pair 48, and is sent downstream in the transport direction. In the present embodiment, the medium feeding path 26 is configured to join the medium transport path 24. Specifically, the medium feeding path 26 joins the medium transport path 24 at a position upstream of the nip position of the feeding roller 36 and the third driven roller 38C in the transport direction.

After the medium fed from the medium feeding unit 18 passes through the medium feeding path 26, the medium is discharged to the discharge stacker 20 through the medium transport path 24. Note that the alternate long and short dash line designated by reference sign P2 in FIG. 3 indicates the path of the medium P traveling along the medium feeding path 26.

The inverting path 28 will be described with reference to FIG. 4. In the present embodiment, the inverting path 28 is configured as a path that inverts a first surface (front surface) and a second surface (rear surface) of the medium. Specifically, the transport roller pair 40 are rotated in reverse, and the medium on which the first surface (surface) has been recorded by the recording head 12 is returned upstream in the transport direction. At this time, the transport roller pair 40 sends the medium P toward the nip point between the feeding roller 36 and the fourth driven roller 38D.

The medium P, having passed through the nip point between the feeding roller 36 and the fourth driven roller 38D, is sent downstream in the transport direction around the inverting roller 34 while being sequentially nipped by the fifth driven roller 38E, the first driven roller 38A, and the second driven roller 38B. The medium P is inverted between the first surface (front surface) and the second surface (rear surface) by going around the inverting roller 34.

The medium P having passed through the second driven roller 38B is nipped by the feeding roller 36 and the third driven roller 38C, and is again sent to the transport roller pair 40. The transport roller pair 40 feeds the second surface of the medium P toward the recording head 12 to an area facing the recording head 12. The recording head 12 performs recording by discharging the ink toward the second surface of the medium P. The medium P on which recording of the second side has been performed is discharged by the discharge roller pair 44 toward the discharge stacker 20.

Note that the alternate long and two short dashes line denoted by reference sign P3 in FIG. 4 indicates the path of the medium P to be inverted along the inverting path 28. In the inverting path 28 in the present embodiment, for example, the path before the medium P is inverted starts from the transport roller pair 40, passes the nip point between the feeding roller 36 and the fourth driven roller 38D and the nip point between the inverting roller 34 and the fifth driven roller 38E, and extends to the nip point between the inverting roller 34 and the first driven roller 38A.

On the other hand, the path after the medium P has been inverted starts from the nip point between the inverting roller 34 and the first driven roller 38A, passes through the nip point between the inverting roller 34 and the second driven roller 38B and the nip point between the feeding roller 36 and the third driven roller 38C, and extends to the transport roller pair 40. In FIG. 4, the "path before the medium P is inverted" is denoted by reference sign 28*a*, and in the following description it will be referred to as a pre-inversion path 28*a*, and the "path after the medium P has been inverted" is denoted by reference sign 28*b*, and in the following description, it will be referred to as a post-inversion path 28*b*.

Unit Body

A unit body 50 will be described with reference to FIGS. 5 to 8. In the present embodiment, the unit body 50 includes the inverting roller 34, the feeding roller 36, the second driven roller 38B, first cleaning rollers 52 as a "cleaning unit" and a "first cleaning unit" described later, and second cleaning rollers 54 as a "second cleaning unit".

An openable and closable cover portion 14*a* is provided on the rear side of the casing 14. Although not illustrated, when the cover portion 14*a* is opened relative to the casing 14, the unit body 50 attached to a predetermined position in the casing 14 can be removed, or the unit body 50 can be mounted at a predetermined position in the casing 14.

Figure 5:
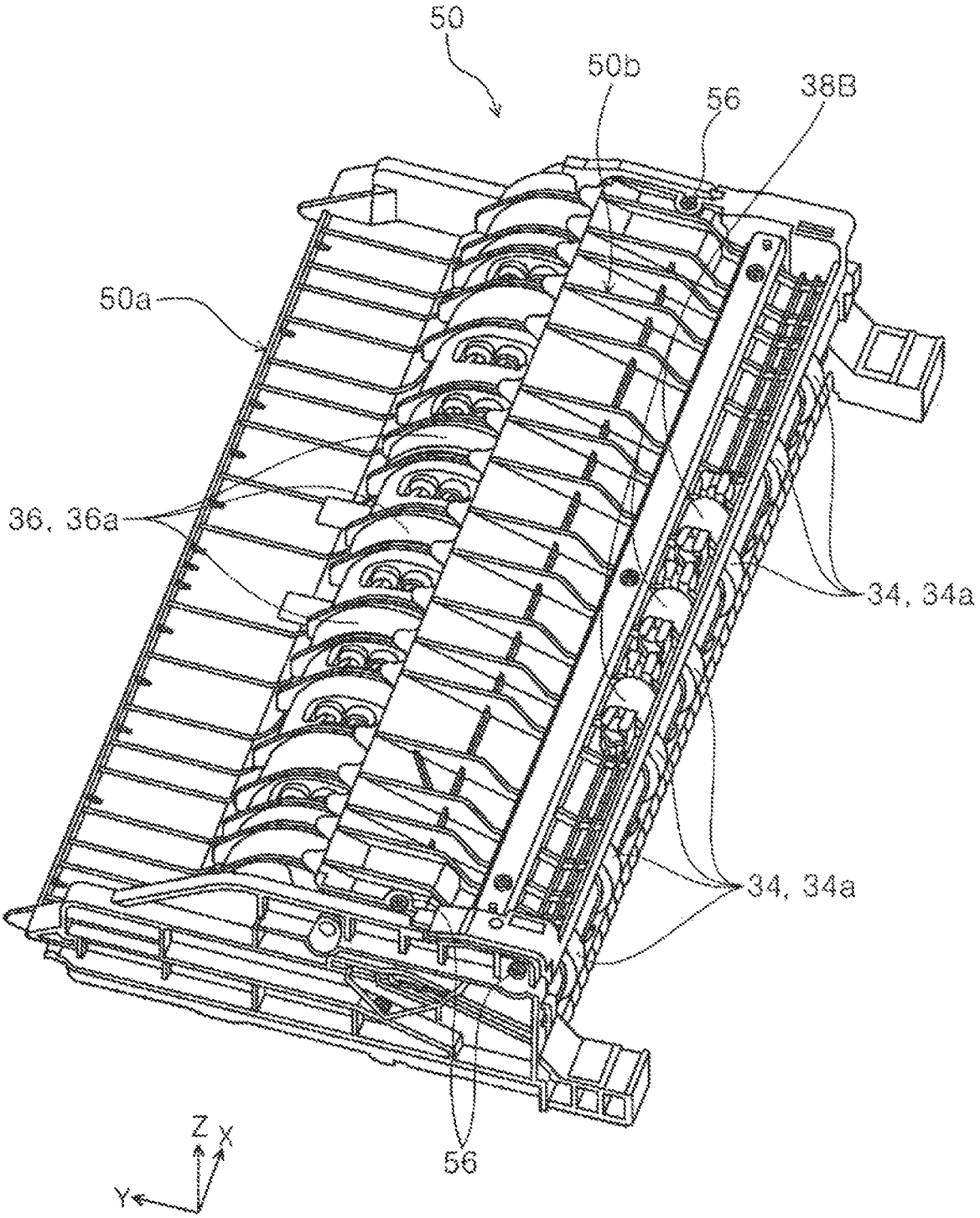
FIG. 5 is an external perspective view of a unit body according to the first embodiment of the present disclosure.

As illustrated in FIG. 5, the unit body 50 includes a main body portion 50*a* and an upper path forming member 50*b*. The upper path forming member 50*b* is attached to the main body portion 50*a* by a plurality of fastening members 56. In the present embodiment, the fastening members 56 are, for example, screw members. The second driven roller 38B is attached to the upper path forming member 50*b* so as to be rotatable. In the present embodiment, the upper path forming member 50*b* is a portion of the path from the nip position between the inverting roller 34 and the second driven roller 38B to the nip position between the feeding roller 36 and the third driven roller 38C, specifically, the path from the nip position between the inverting roller 34 and the second driven roller 38B to the joining position at which it joins with the medium feeding path 26 (refer to FIG. 3).

Figure 6:
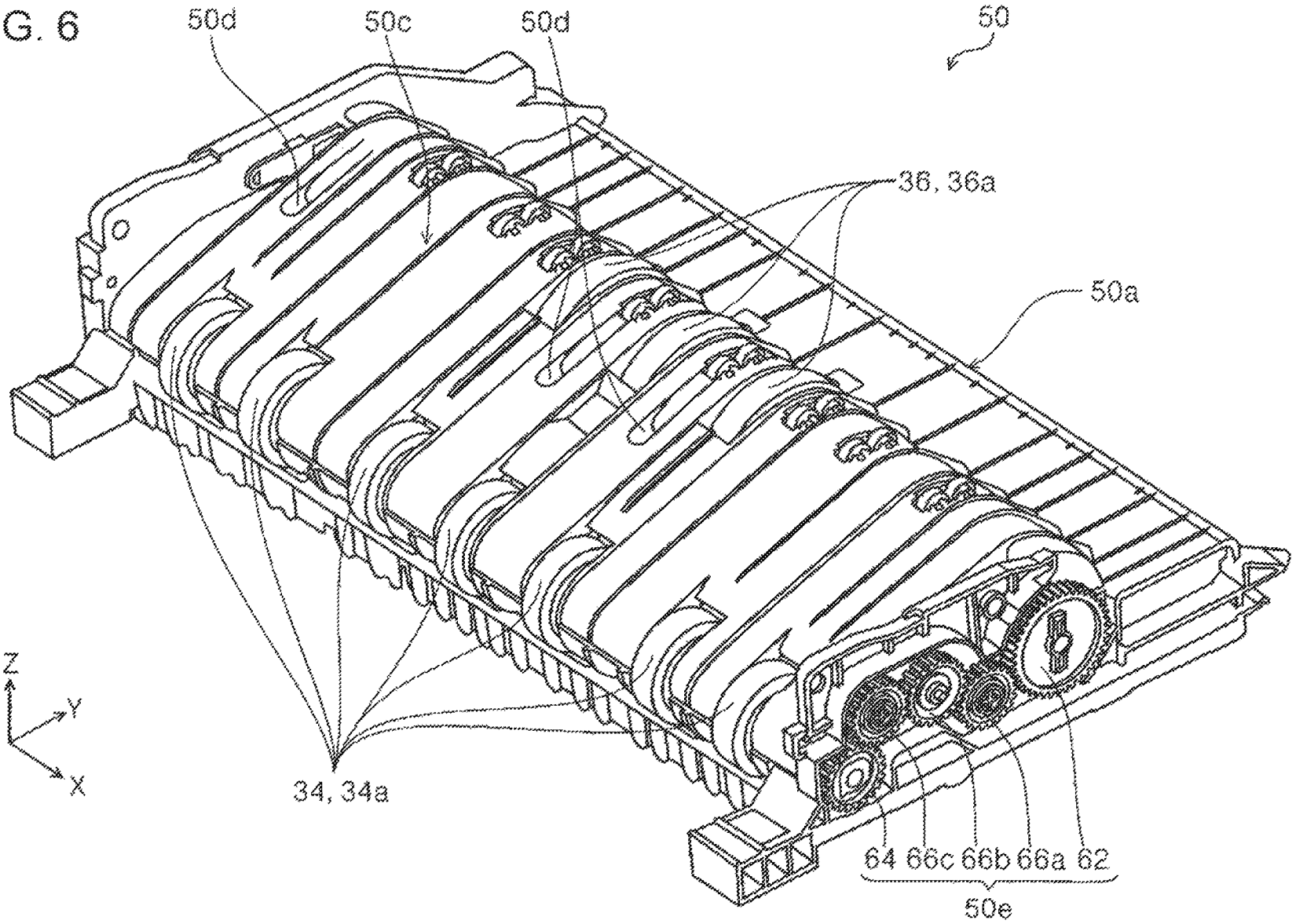
FIG. 6 is a perspective view of the unit body in a state where a driven roller and an upper path forming member have been removed.

By loosening the fastening member 56 and removing the upper path forming member 50*b* from the main body portion 50*a*, a post-inversion-path-forming portion 50*c* constituting the upper portion of the main body portion 50*a* is exposed as illustrated in FIG. 6. In this state, at a rear end portion of the main body portion 50*a*, a portion of the inverting roller 34 protrudes from the post-inversion-path-forming portion 50*c*. A portion of the feeding roller 36, at a position on the post-inversion-path-forming portion 50*c* in the +Y-axis direction from the inverting roller 34, protrudes from the post-inversion-path-forming portion 50*c*.

In the post-inversion-path-forming portion 50*c*, fastening portions 50*d* are formed at appropriate intervals in the X-axis direction. The post-inversion-path-forming portion 50*c* can be attached to and detached from the main body portion 50*a* by tightening or loosening fastening members (not illustrated) in the fastening portion 50*d*. In the present embodiment, the fastening portions 50*d* are, for example, formed at four places including one not illustrated. In the present embodiment, the fastening members (not illustrated) are screw members.

Figure 7:
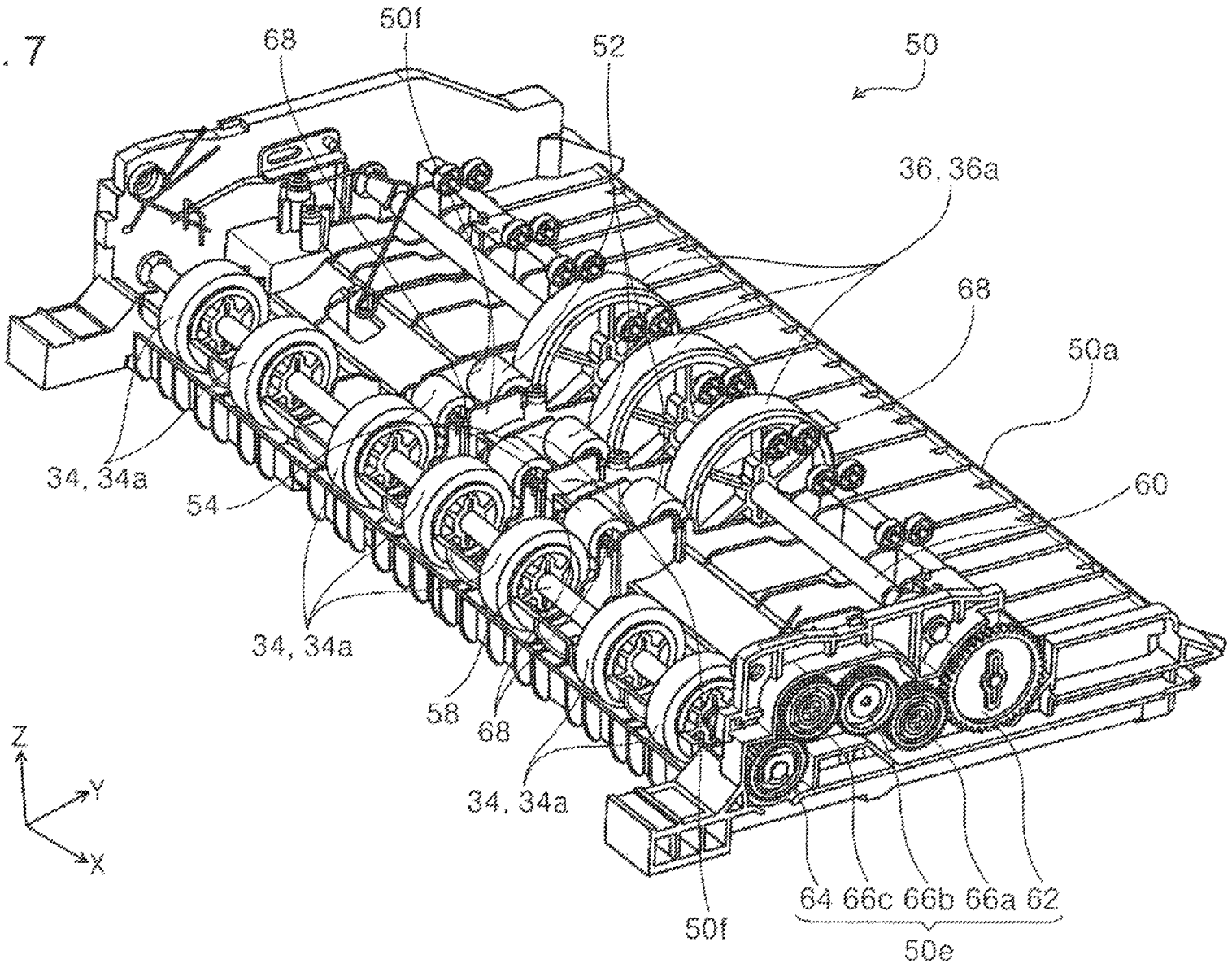
FIG. 7 is a perspective view of a state in which the feeding roller, the inverting roller, a first cleaning roller and a second cleaning roller are exposed in the unit body.
Figure 8:
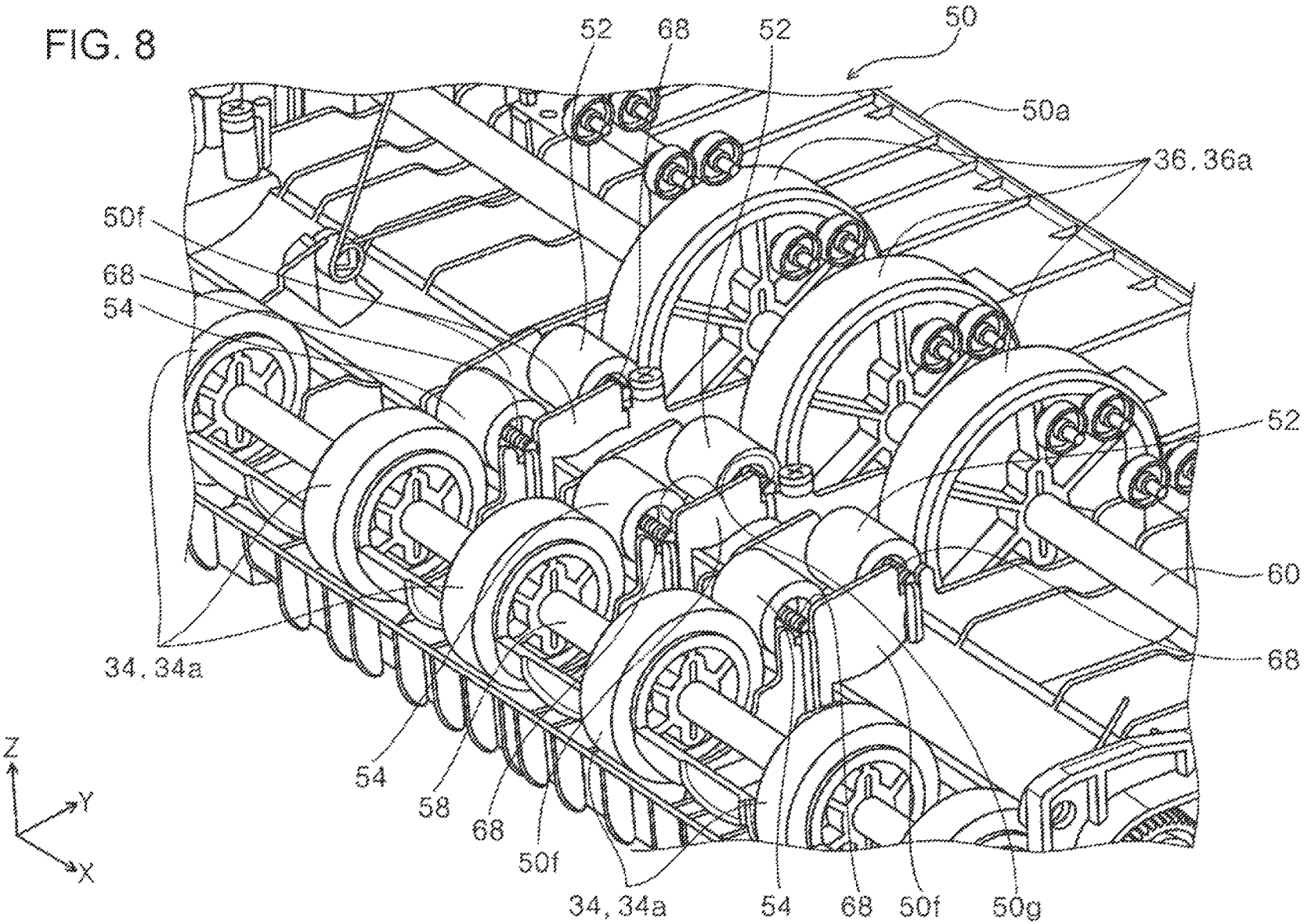
FIG. 8 is an enlarged view of the feeding roller, the inverting roller, the first cleaning roller, and the second cleaning roller in FIG. 7.

When the fastening members (not illustrated) are loosened and the post-inversion-path-forming portion 50*c* is removed from the main body portion 50*a*, as illustrated in FIGS. 7 and 8, the inverting roller 34, the feeding roller 36, the first cleaning rollers 52, and the second cleaning rollers 54 are exposed. In the present embodiment, the inverting roller 34, the feeding roller 36, the first cleaning rollers 52, and the second cleaning rollers 54 are disposed on the unit body 50 that is configured to attach to and detach from the casing 14.

Thus, the roller provided in the unit body 50 can be replaced by removing the unit body 50 from the casing 14 and removing the upper path forming member 50*b* and the post-inversion-path-forming portion 50*c* from the main body portion 50*a*. As a result, compared with the configuration in which these rollers are assembled in the casing 14, the remounting operation can be performed in a state in which the unit body 50 is removed from the casing 14 and maintenance can be improved.

In the present embodiment, the inverting roller 34 is provided in a plurality in the main body portion 50*a*. Specifically, the plurality of inverting rollers 34 are disposed at appropriate intervals in the X-axis direction and attached to a rotation shaft 58 so as to rotate with the rotation shaft 58. In the present embodiment, for example, seven inverting rollers 34 are provided.

The feeding roller 36 is also provided in a plurality in the main body portion 50*a*. Specifically, the plurality of feeding rollers 36 are disposed at appropriate intervals in the X-axis direction and attached to a rotation shaft 60 so as to rotate with the rotation shaft 60. In the present embodiment, for example, three feeding rollers 36 are provided. Note that among the seven inverting rollers 34 in the X-axis direction, the positions of the three inverting rollers 34 disposed on the inner side correspond to the positions of the feeding rollers 36.

A driving force transmitting unit 50*e* is disposed at the +X axial direction side end of the main body portion 50*a*. The driving force transmitting unit 50*e* is configured to include a feeding-roller drive gear 62, an inverting-roller drive gear 64, and a plurality of gears 66*a*, 66*b*, and 66*c*.

In the present embodiment, the feeding-roller drive gear 62 is, for example, attached to the +X axial direction side end of the rotation shaft 60 of the feeding roller 36. On the other hand, the inverting-roller drive gear 64 is attached to the +X axial direction side end of the rotation shaft 58 of the inverting roller 34.

The driving force transmitting unit 50*e* has a configuration in which adjacent gears mesh so that a driving force is transmitted in the order of the feeding-roller drive gear 62, the gear 66*a*, the gear 66*b*, the gear 66*c*, and the inverting-roller drive gear 64. In the present embodiment, the rotational direction of the feeding-roller drive gear 62 and the rotational direction of the inverting-roller drive gear 64 in the driving force transmitting unit 50*e* are configured to be the same rotational direction.

In the present embodiment, for example, the feeding-roller drive gear 62 is configured to receive a driving force from a drive source (not illustrated) provided in the casing 14 when the unit body 50 is mounted in the casing 14. The driving force received by the feeding-roller drive gear 62 is transmitted to the inverting-roller drive gear 64 via the gears 66*a*, 66*b*, and 66*c*.

Configuration of Cleaning Roller

In FIGS. 7 and 8, in the main body portion 50*a*, a plurality of pairs of bearing portions 50*f* are formed between the inverting rollers 34 and the feeding rollers 36 in the Y-axis direction. Each of the bearing portions 50*f* is formed as a rib-like portion extending along the Y-axis direction and projecting in the +Z-axis direction. In each of the bearing portions 50*f*, a bearing 50*g*, which is recessed, (refer to FIG. 8) is formed at the +Y direction side end and the −Y direction side end portions of the bearing portion 50*f*.

Figure 9:
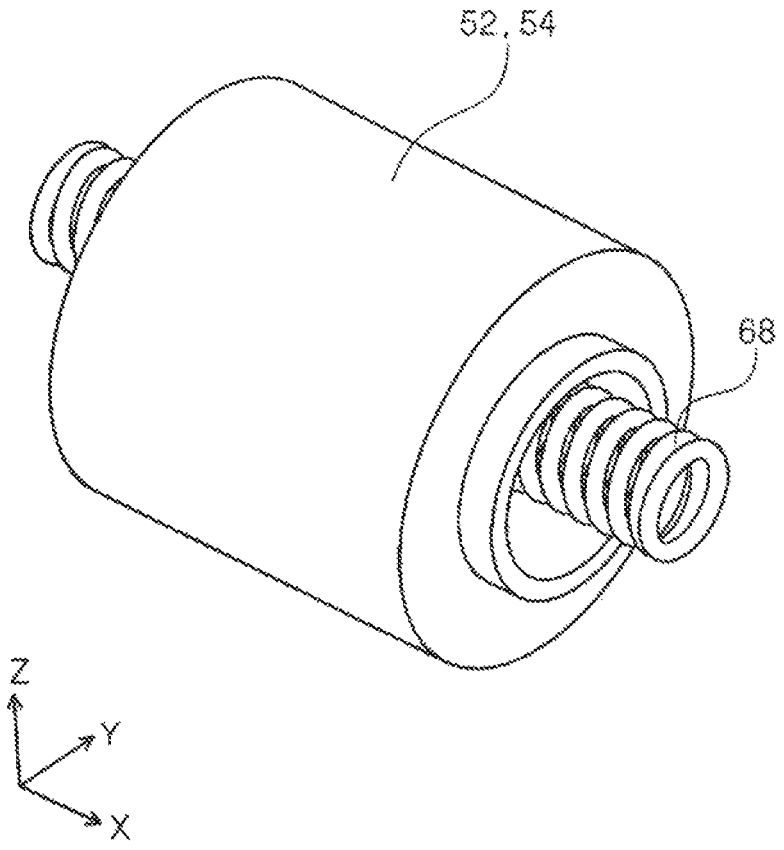
FIG. 9 is a perspective view illustrating a configuration of the first cleaning roller and the second cleaning roller.

Here, in FIG. 9, the first cleaning rollers 52 and the second cleaning rollers 54 are for example, cylindrical members. For example, the first cleaning rollers 52 and the second cleaning rollers 54 are liquid absorbers, such as sponges, capable of absorbing a liquid (ink). Rod springs 68 as a "pressing member" are passed through the first cleaning rollers 52 and the second cleaning rollers 54, both of which have a cylindrical shape. In the present embodiment, for example, the rod springs 68 are spring-like members.

Again, in FIG. 7 and FIG. 8, the plurality of pairs of bearing portions 50*f* are provided at positions corresponding to the arrangement positions of the feeding rollers 36 in the X-axis direction. A pair of bearing portions 50*f* disposed so as to correspond to one feeding roller 36 are disposed at a predetermined distance from each other in the X-axis direction, and the first cleaning rollers 52 and the second cleaning rollers 54 are disposed between the opposing bearing portions 50*f* so as to be capable of rotation. In the present embodiment, the second cleaning rollers 54 are disposed so as to correspond to the inverting rollers 34 disposed at a position corresponding to the arrangement position of the feeding rollers 36. Specifically, three inverting rollers 34 out of the seven inverting rollers 34 disposed in the X-axis direction correspond to the three inverting rollers 34 disposed toward the inside in the X-axis direction.

In the present embodiment, the first cleaning rollers 52 are disposed in contact with outer circumferential surfaces 36*a* of the feeding rollers 36 and are configured to be driven to rotate as the feeding rollers 36 rotate. Similarly, the second cleaning rollers 54 are disposed in contact with outer circumferential surfaces 34*a* of the inverting rollers 34 and are configured to be driven to rotate as the inverting rollers 34 rotate. In the present embodiment, since the cleaning rollers perform cleaning by coming into contact with the above-mentioned rollers, adhesion of dirt to the medium can be suppressed.

In the present embodiment, both X-axis direction side end portions of the rod springs 68 passed through the first cleaning rollers 52 are supported by the bearings 50*g* on the +Y direction side end portions of the pair of bearing portions 50*f*. Similarly, both X-axis direction side end portions of the rod springs 68 passed through the second cleaning rollers 54 are supported by bearings 50*g* at the −Y direction side end portions of the pair of bearing portions 50*f*.

In the present embodiment, the first cleaning rollers 52 are configured to press against the outer circumferential surfaces 36*a* of the feeding rollers 36. Specifically, the bearings 50*g* at the +Y axial direction side end portions of the bearing portions 50*f* are disposed at positions where the first cleaning rollers 52 in contact with the outer circumferential surfaces 36*a* of the feeding rollers 36 cause the rod springs 68 to bow in the −Y axis direction. As a result, an elastic force is generated in the rod springs 68 and the first cleaning rollers 52 are pressed against the outer circumferential surfaces 36*a* of the feeding rollers 36. Thus, because the first cleaning rollers 52 can be in close contact with the outer circumferential surfaces 36*a* of the feeding rollers 36, the removability of the dirt adhered to the outer circumferential surfaces 36*a* of the feeding rollers 36 can be improved.

Similarly, the second cleaning rollers 54 are configured to press the outer circumferential surfaces 34*a* of the inverting rollers 34. Specifically, the bearings 50*g* at the −Y axial direction side end portions of the bearing portions 50*f* are disposed at positions where the second cleaning rollers 54 in contact with the outer circumferential surfaces 34*a* of the inverting rollers 34 cause the rod springs 68 to bow in the +Y axis direction. As a result, an elastic force is generated in the rod springs 68 and the second cleaning rollers 54 are pressed against the outer circumferential surfaces 34*a* of the inverting rollers 34. Since the second cleaning rollers 54 are also in close contact with the outer circumferential surfaces 34*a* of the inverting rollers 34, the removability of the dirt adhered to the outer circumferential surfaces 34*a* can be improved.

Next, in FIG. 10 and FIG. 11, the arrangement of the first cleaning rollers 52 and the second cleaning rollers 54 will be described. In the present embodiment, the first cleaning rollers 52 and the second cleaning rollers 54 are disposed between the inverting rollers 34 and the feeding rollers 36 in the Y-axis direction when the medium transport path 24 is seen in side view. Specifically, the first cleaning rollers 52 and the second cleaning rollers 54 are disposed in a space 50*h* between the inverting rollers 34 and the feeding rollers 36 in the main body portion 50*a* of the unit body 50. Therefore, the first cleaning rollers 52 and the second cleaning rollers 54 can be disposed by effectively utilizing the space in the unit body 50. As a result, it is possible to suppress an increase in the size of the inverting path 28 and hence the main body portion 50*a*.

Figure 10:
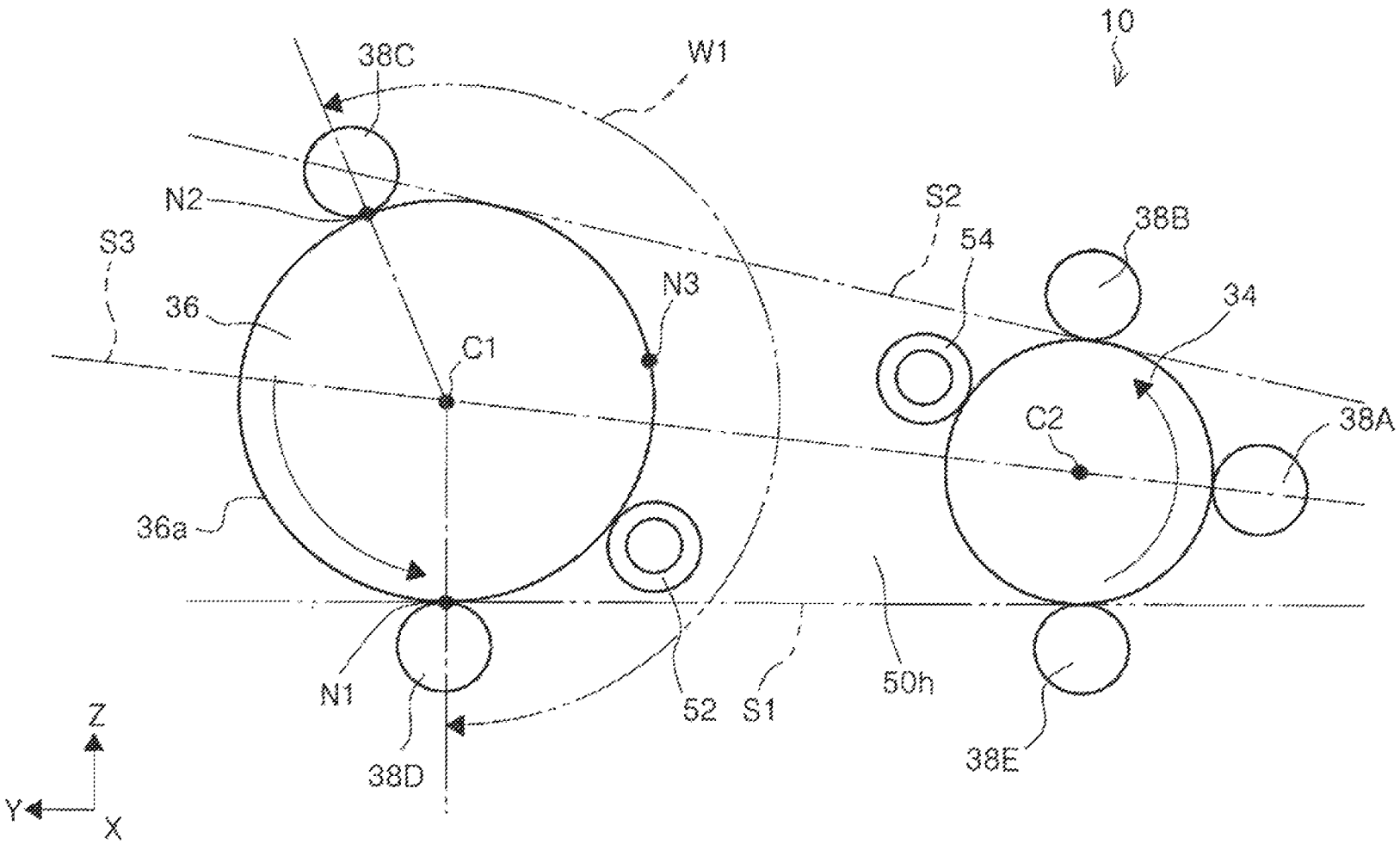
FIG. 10 is a schematic view illustrating a positional relationship between the feeding roller, the inverting roller, the first cleaning roller, and the second cleaning roller.

In FIG. 10, the nip position between the feeding roller 36 and the fourth driven roller 38D is set as a first position N1, and the nip position between the feeding roller 36 and the third driven roller 38C is set as a second position N2. In the present embodiment, the first cleaning roller 52 is disposed on the outer circumferential surface 36*a* of the feeding roller 36 so as to be in contact with the outer circumferential surface 36*a* in an area W1 between the first position N1 on the side of the inverting roller 34 and the second position N2.

More specifically, the first cleaning roller 52 is disposed in a region W1 between the first position N1 and the second position N2 on the outer circumferential surface 36*a* of the feeding roller 36 so as to be in contact with the portion of the outer circumferential surface 36*a* in contact with the medium P before the portion of the outer circumferential surface 36*a* in contact with the medium P at the first position N1 reaches the second position N2 with rotation of the feeding roller 36.

Figure 11:
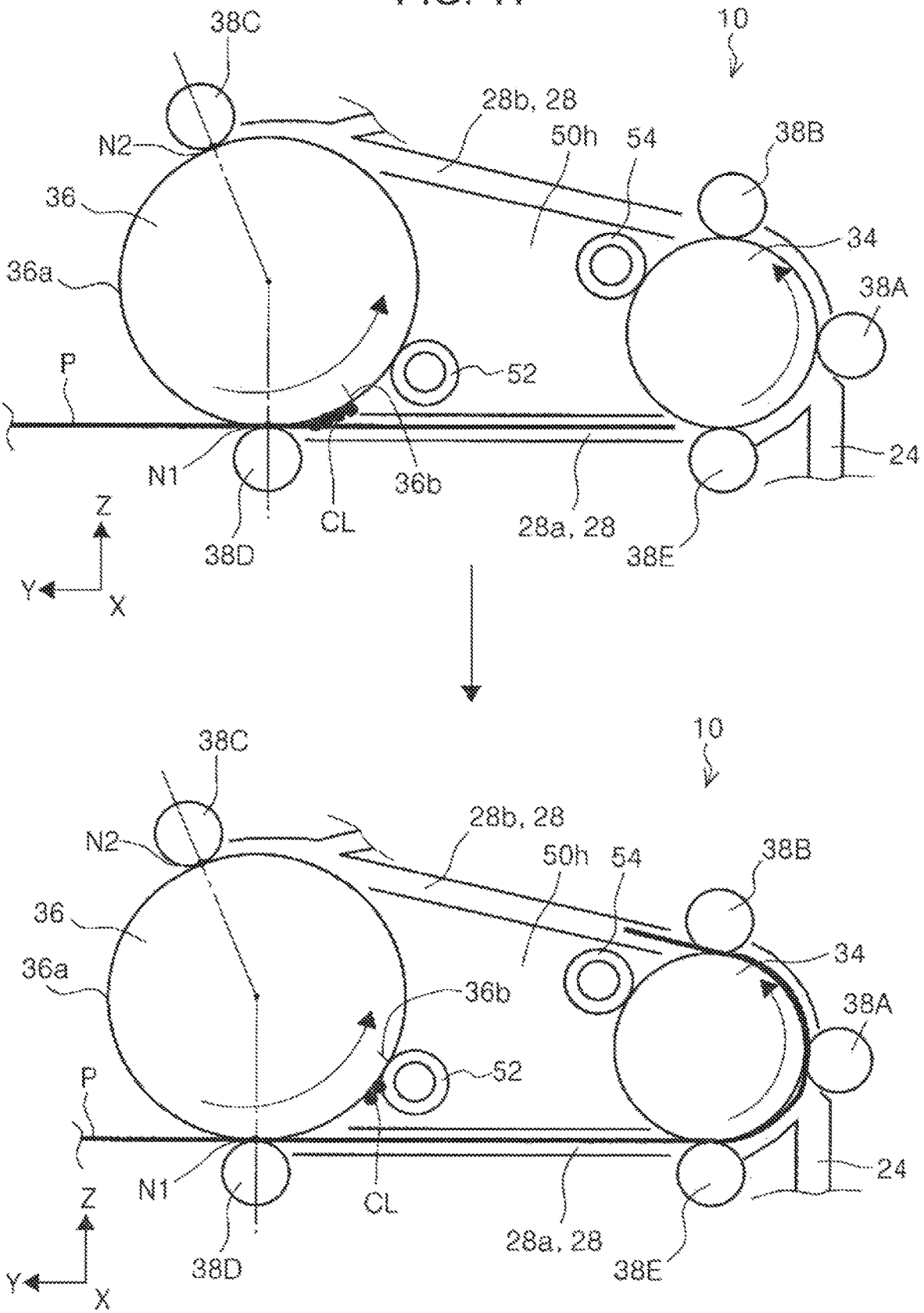
FIG. 11 is a schematic view illustrating the operation of the first cleaning roller according to the present disclosure.

In an upper diagram of FIG. 11, when the medium P is nipped between the feeding roller 36 and the fourth driven roller 38D at the first position N1 and fed toward the inverting roller 34, it is assumed that, for example, the ink CL adheres to the outer circumferential surface 36*a* of the feeding roller 36 from the medium P at the first position N1. In the outer circumferential surface 36*a* of the feeding roller 36, the portion to which the ink CL adheres at the first position N1 is an ink adherence portion 36*b*.

In the upper and lower diagrams of FIG. 11, an ink-adherence portion 36*b* moves from the first position N1 to which the ink has adhered to the second position N2 with rotation of the feeding roller 36. At this time, if the first cleaning roller 52 does not contact the feeding roller 36 between the first position N1 and the second position N2, the second position N2 is reached while the ink CL is still adhered to the ink-adherence portion 36*b*.

Here, when the medium P inverted by the inverting roller 34 is nipped between the feeding roller 36 and the third driven roller 38C at the second position N2, the ink CL adhered to the ink-adherence portion 36*b* might adhere to the first surface of the medium P and soil the first surface.

In the present embodiment, while the ink-adherence portion 36*b* moves from the first position N1 to the second position N2, since the first cleaning roller 52 in contact with the outer circumferential surface 36*a* absorbs the ink CL attached to the ink-adherence portion 36*b*, the adhesion of the ink CL to the first surface of the medium P after the inversion can be suppressed. As a result, it is possible to suppress a decrease in the recording quality on the first surface of the medium P.

Here, even though the arrangement position of the first cleaning roller 52 may be disposed at a position in contact with the feeding roller 36 between the first position N1 and the second position N2 in the region W1, it is more desirable for the first cleaning roller 52 to be disposed at a position between an intermediate position N3 (FIG. 10), which is between the first position N1 and the second position N2, and the first position N1. Consequently, the first cleaning roller 52 can be in contact with the ink-adherence portion 36*b* at a position closer to the first position N1. As a result, since the first cleaning roller 52 can absorb the ink adhering to the outer circumferential surface 36*a* before drying of the ink progresses and viscosity of the ink increases, it is possible to reliably remove dirt on the outer circumferential surface 36*a* of the feeding roller 36.

Next, in FIG. 10, a common tangential line between the position of the feeding roller 36 facing the first position N1 and the outer circumferential surface 34*a* of the inverting roller 34 is taken as a first tangential line S1 and a common tangential line between the outer circumferential surface 36*a* of the feeding roller 36 on the second position N2 side and the outer circumferential surface 34*a* of the inverting roller 34 is taken as a second tangential line S2. In the present embodiment, the first cleaning roller 52 and the second cleaning roller 54 are positioned inside the first tangential line S1 and the second tangential line S2 in the Z-axis direction in the space 50*h*.

As a result, because the first cleaning roller 52 and the second cleaning roller 54 are not disposed outside the first tangential line S1 and the second tangential line S2, the path length of the inverting path 28 can be shortened and the throughput of the medium P during double-sided recording can be improved because the pre-inversion path 28*a* and the post-inversion path 28*b* can be disposed along the first tangential line S1 and the second tangential line S2, respectively.

In FIG. 10, a rotation center of the feeding roller 36 is C1, a rotation center of the inverting roller 34 is C2, and an imaginary line connecting the rotation center C1 and the rotation center C2 is S3. In the present embodiment, the first cleaning roller 52 is disposed on the first tangential line S1 side, which is a first side with respect to the imaginary line S3, namely, the pre-inversion path 28*a* side. On the other hand, the second cleaning roller 54 is disposed on the second tangential line S2 side, which is a second side with respect to the imaginary line S3, namely, the post-inversion path 28*b* side.

In the present embodiment, the first cleaning roller 52 and the second cleaning roller 54 are disposed on opposite sides of the imaginary line S3. Furthermore, in the present embodiment, the first cleaning roller 52 and the second cleaning roller 54 are disposed diagonally to the imaginary line S3. Here, when the first cleaning roller 52 and the second cleaning roller 54 are collectively disposed on the first tangential line side S1 or the second tangential line side S2 with respect to the imaginary line S3, the size of the cleaning roller is limited to the size in the Y-axis direction of the space 50*h* between the inverting roller 34 and the feeding roller 36 in the main body portion 50*a*, particularly the size at the position where the imaginary line S3 passes.

In the present embodiment, the size of the cleaning roller can be increased by disposing the first cleaning roller 52 and the second cleaning roller 54 opposite to each other with respect to the imaginary line S3, more preferably, by disposing the first cleaning roller 52 and the second cleaning roller 54 at diagonal positions. As a result, the ink absorption capacity of the cleaning rollers can be increased and the lifetime of the cleaning rollers can be improved.

In this embodiment, since the cleaning unit that cleans the inverting roller 34 and the feeding roller 36 is formed of cleaning rollers that are driven to rotate relative to the inverting roller 34 and the feeding roller 36, the contact portion on the cleaning rollers can be changed with rotation of the inverting roller 34 and the feeding roller 36, the cleaning performance of the cleaning rollers can be maintained, and the lifetime of the cleaning rollers can be prolonged.

Figure 12:
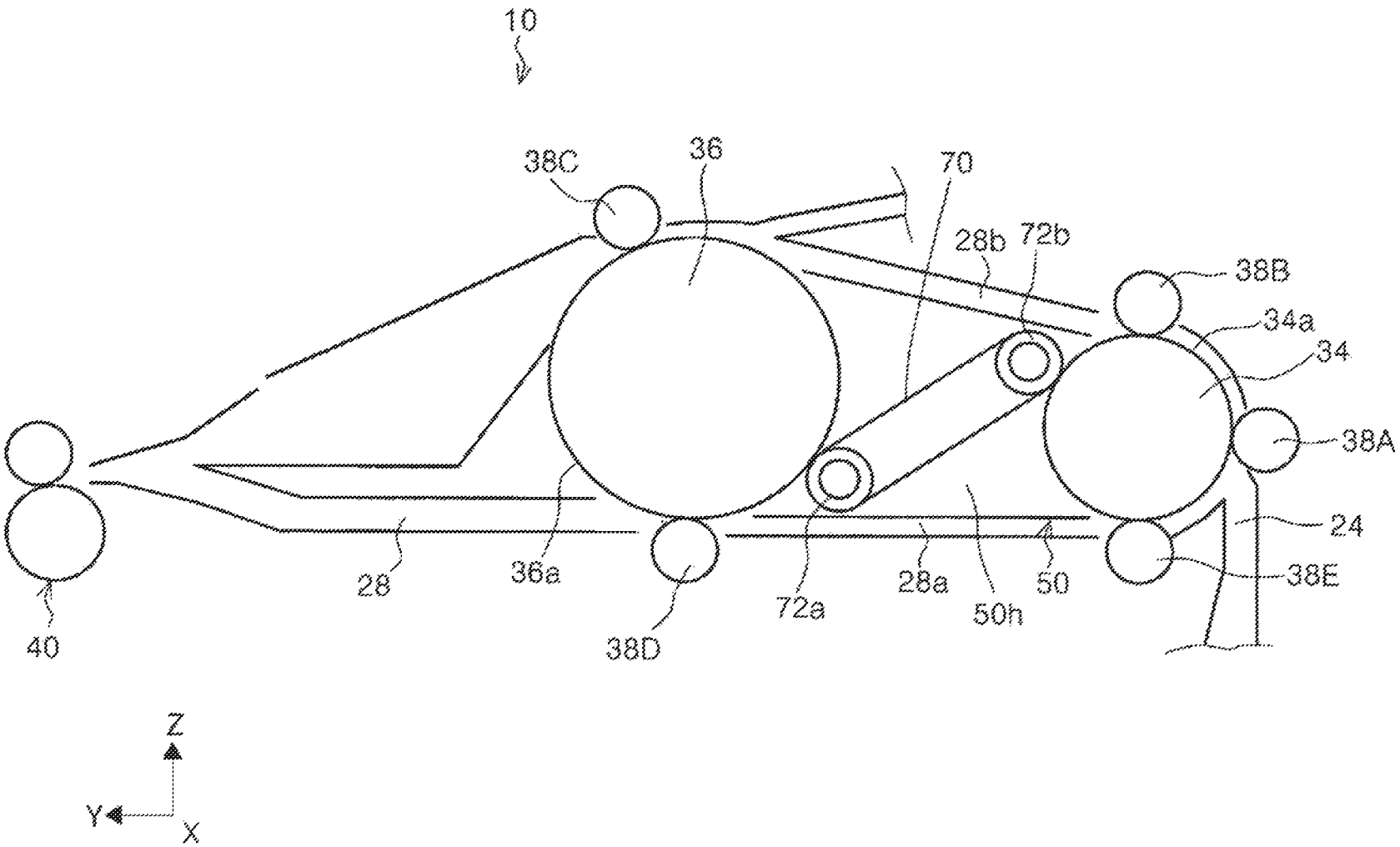
FIG. 12 is a schematic view illustrating a first modification of the first embodiment.

Modification of First Embodiment (1) Instead of providing the first cleaning roller 52 and the second cleaning roller 54, a cleaning belt 70 may be provided as illustrated in FIG. 12. As illustrated in FIG. 12, the cleaning belt 70 is wound around a first roller 72*a* and a second roller 72*b*. The cleaning belt 70 is in contact with both the inverting roller 34 and the feeding roller 36, and when the inverting roller 34 and the feeding roller 36 rotate, the cleaning belt 70 also rotates. As a result, the outer circumferential surface 34*a* of the inverting roller 34 and the outer circumferential surface 36*a* of the feeding roller 36 are cleaned by the cleaning belt 70. By forming the cleaning unit as a cleaning belt, it is possible to extend the lifetime of the cleaning unit.

Figure 13:
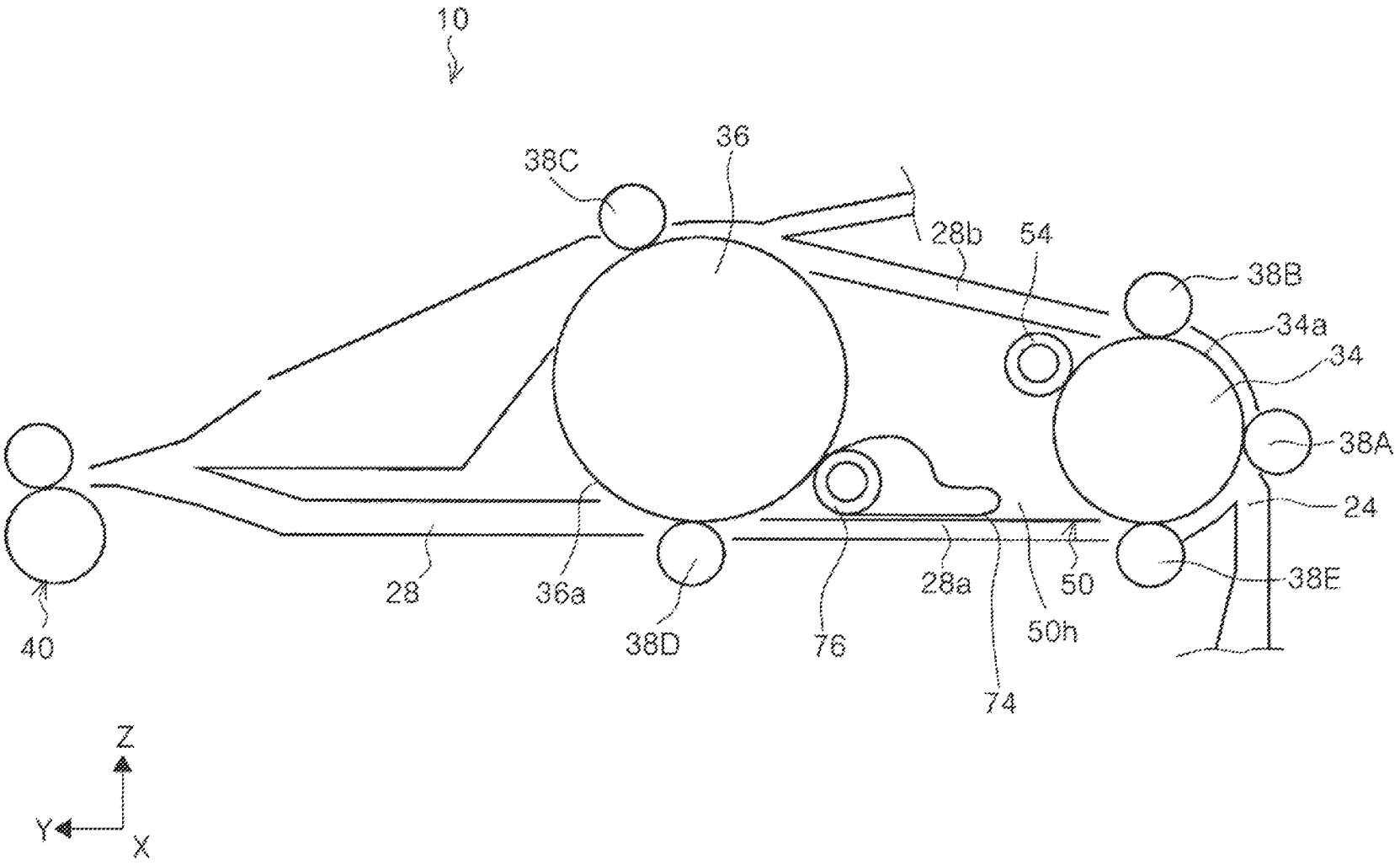
FIG. 13 is a schematic view illustrating a second modification of the first embodiment.

(2) Instead of providing the first cleaning roller 52 and the second cleaning roller 54, as illustrated in FIG. 13, a cleaning member 74, which is belt-like and formed in an annular shape, may be provided. In this modification, a roller 76 is provided so as to press the cleaning member 74 against the outer circumferential surface 36*a* of the feeding roller 36. In this embodiment, when the feeding roller 36 rotates, the roller 76 is driven to rotate relative to the feeding roller 36 via the cleaning member 74 by friction. As a result, the cleaning member 74 is sequentially fed to the outer circumferential surface 36*a* of the feeding roller 36, and the outer circumferential surface 36*a* can be cleaned.

Figure 14:
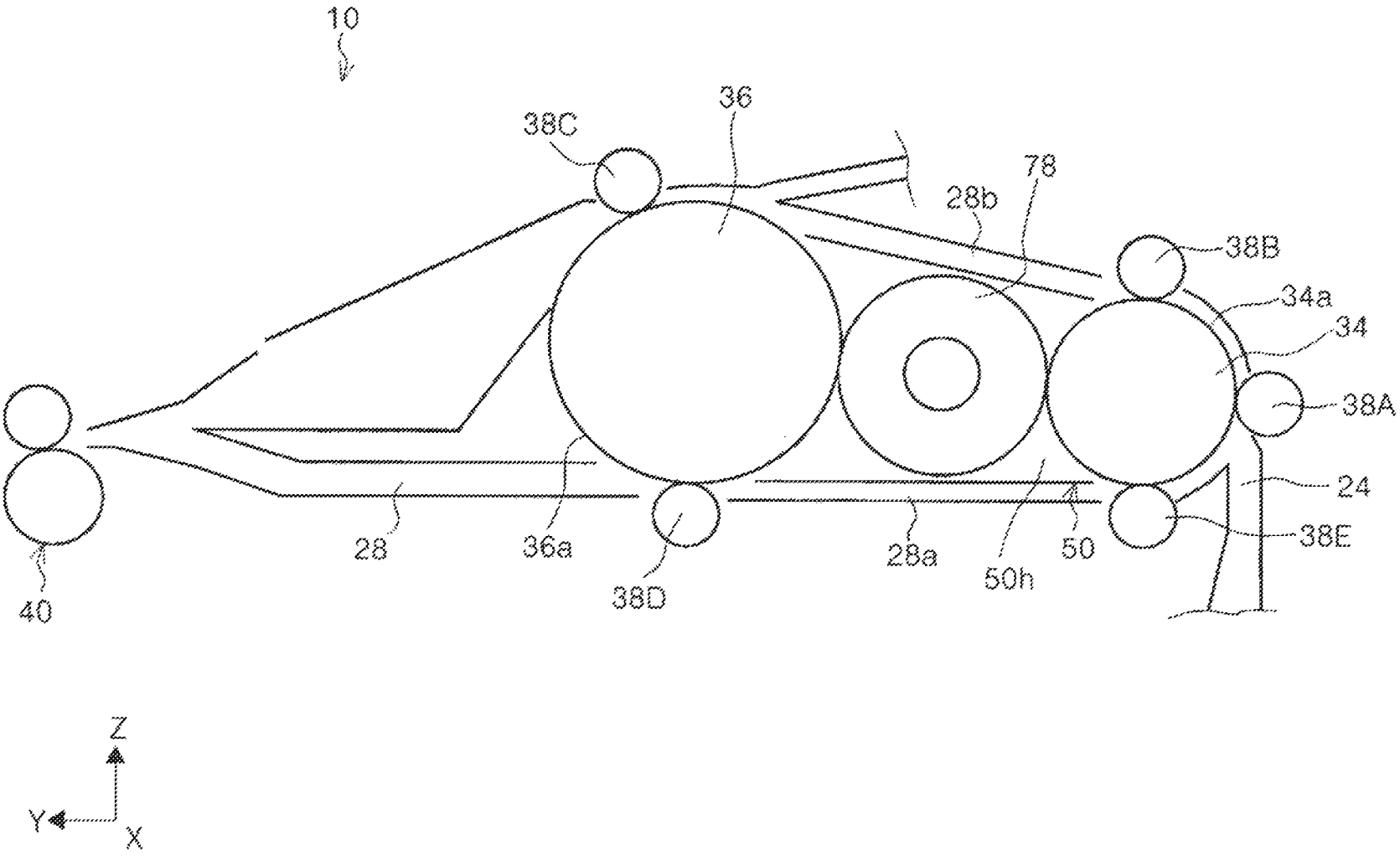
FIG. 14 is a schematic view illustrating a third modification of the first embodiment.

(3) Instead of providing the first cleaning roller 52 and the second cleaning roller 54, as illustrated in FIG. 14, a single cleaning roller 78 in contact with both the inverting roller 34 and the feeding roller 36 may be provided. In this configuration, the cleaning of the outer circumferential surface 34*a* of the inverting roller 34 and the outer circumferential surface 36*a* of the feeding roller 36 can be performed by the single cleaning roller 78, and the configuration of the device can be simplified.

(4) Instead of forming the cleaning unit as rollers such as the first cleaning roller 52 and the second cleaning roller 54, in order to clean the outer circumferential surface 34*a* of the inverting roller 34 and the outer circumferential surface 36*a* of the feeding roller 36, a pad member or a wiper blade may be used. This is similarly applicable to a second embodiment described below.

Second Embodiment

A second embodiment will be described with reference to FIGS. 15 to 18. This embodiment differs from the first embodiment in that the diameter of the inverting roller is made substantially the same as the diameter of the feeding roller and the outer circumferential surfaces of both the feeding roller and the inverting roller are cleaned by a single cleaning unit that can be displaced in a direction toward and away from the feeding roller and the inverting roller. Note that the diameter of the inverting roller and the diameter of the feeding roller in the present embodiment do have to be exactly the same, and variations such as manufacturing errors are permitted. In addition, the configuration is the same as that of the first embodiment except for the above mentioned difference in configuration.

Figure 15:
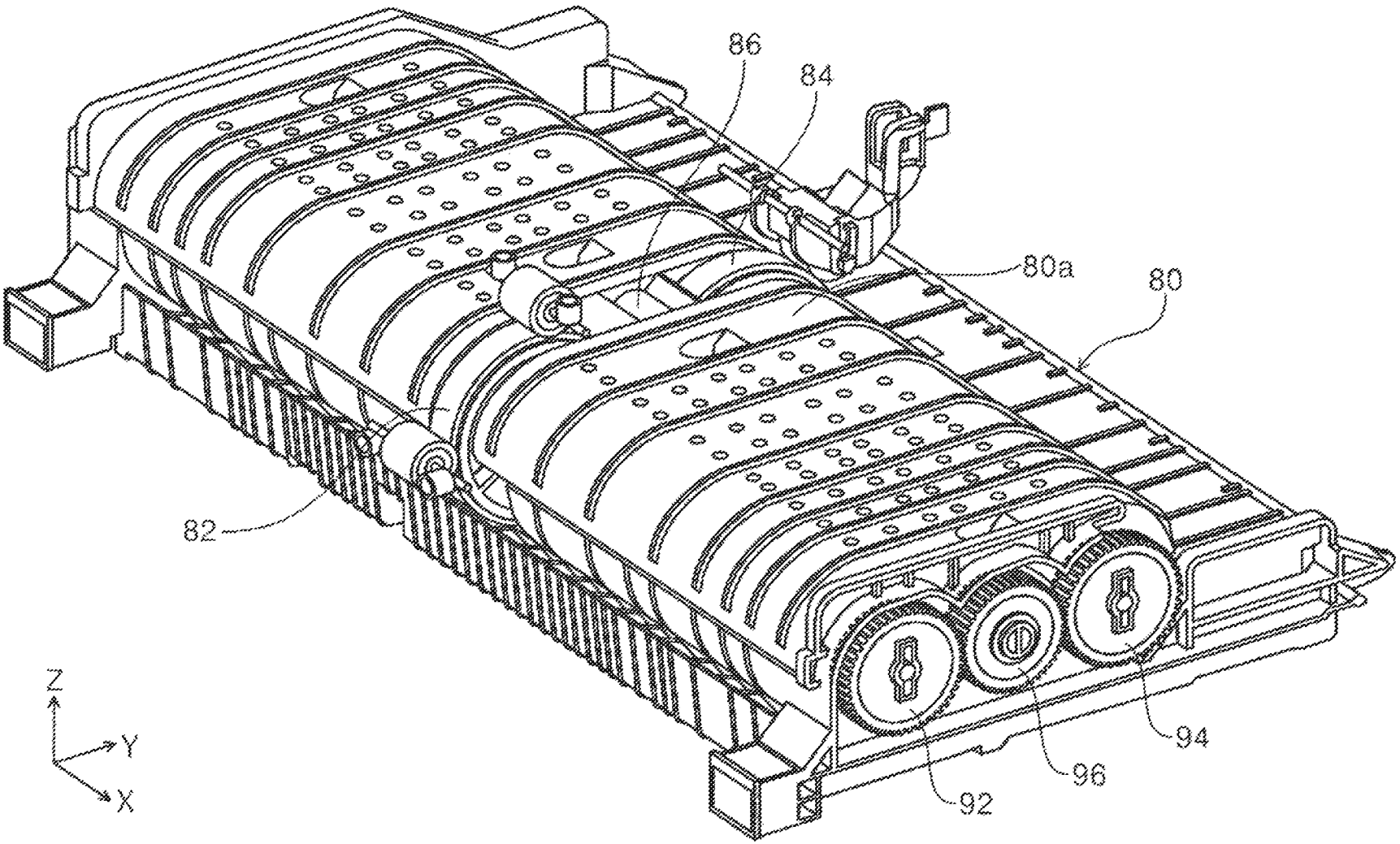
FIG. 15 is a perspective view of a unit body according to a second embodiment.
Figure 16:
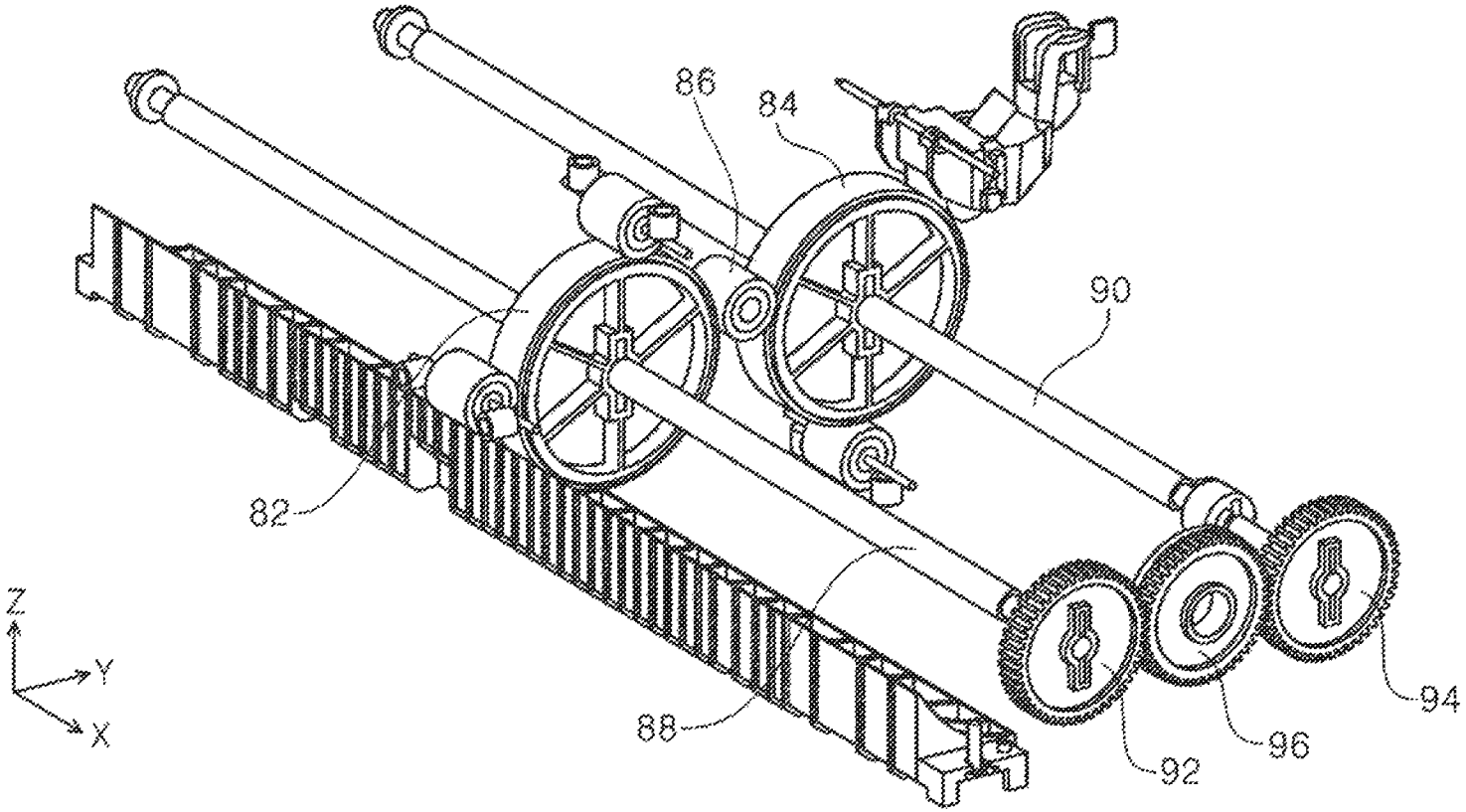
FIG. 16 is a perspective view illustrating the relationship between a feeding roller, an inverting roller, and a cleaning roller according to the second embodiment.

In FIGS. 15 and 16, a unit body 80 that is configured to attach to and detach from the casing 14 includes an inverting roller 82, a feeding roller 84, and a cleaning roller 86. The inverting roller 82 is attached to a rotation shaft 88 and the feeding roller 84 is attached to a rotation shaft 90. An inverting-roller drive gear 92 is attached to an +X axial direction side end portion of the rotation shaft 88. A feeding-roller drive gear 94 is attached to a +X axial direction side end portion of the rotation shaft 90.

The inverting-roller drive gear 92 meshes with a gear 96, and the gear 96 meshes with the feeding-roller drive gear 94. When the unit body 80 is mounted in the casing 14, a driving force is transmitted to the feeding-roller drive gear 94 from a drive source (not illustrated) in the casing 14. The driving force of the feeding-roller drive gear 94 is transmitted to the inverting-roller drive gear 92 via the gear 96. In the present embodiment, the inverting roller 82 and the feeding roller 84 rotate in the same direction.

Figure 17:
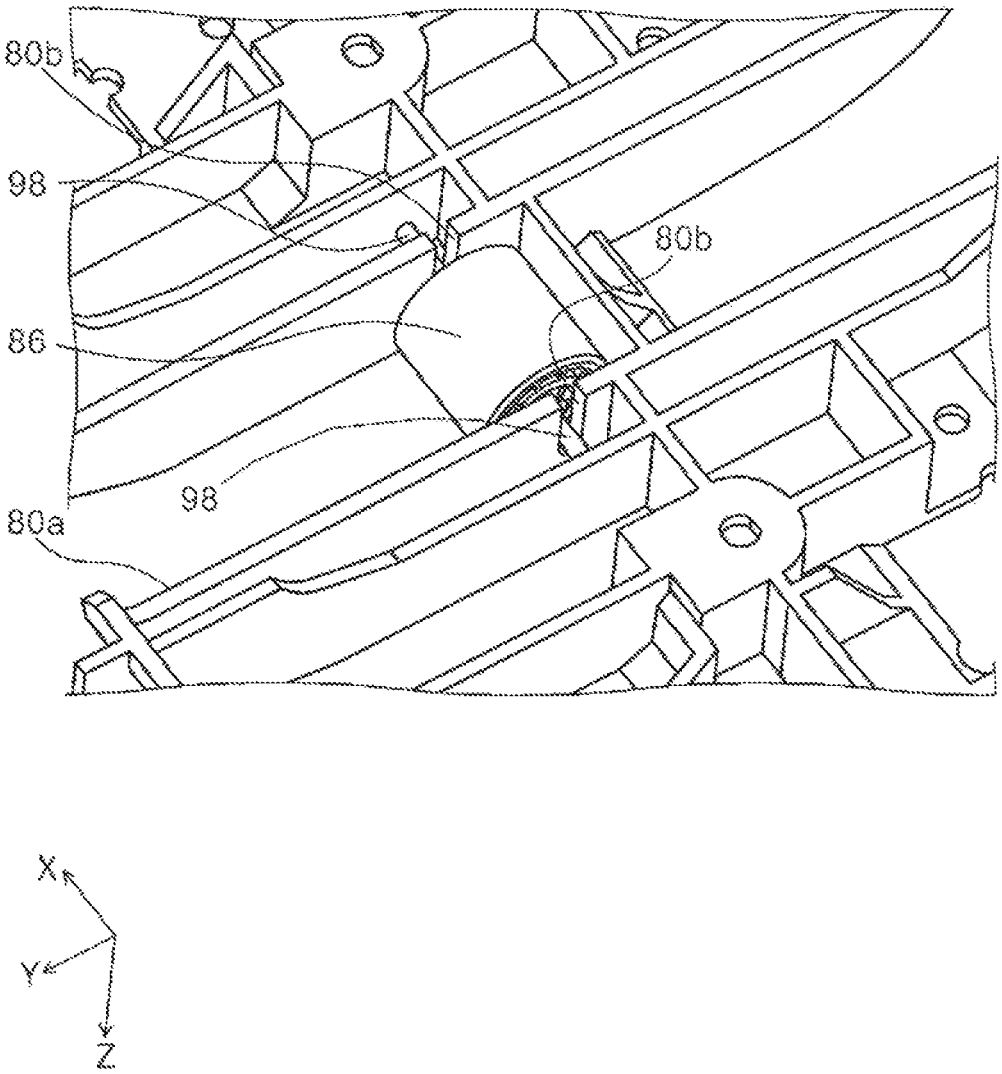
FIG. 17 is a perspective view illustrating the relationship between a rotation axis and a groove of the cleaning roller according to the second embodiment.

In FIG. 17, the cleaning roller 86 is provided with a rotation shaft 98. The rotation shaft 98 is provided on the bottom surface of a post-inversion path forming portion 80*a* of the unit body 80, and is inserted into grooves 80*b* extending along the Z-axis direction. In the present embodiment, the rotation shaft 98 and thus the cleaning roller 86 are configured to be displaced in the Z-axis direction along the grooves 80*b*.

Figure 18:
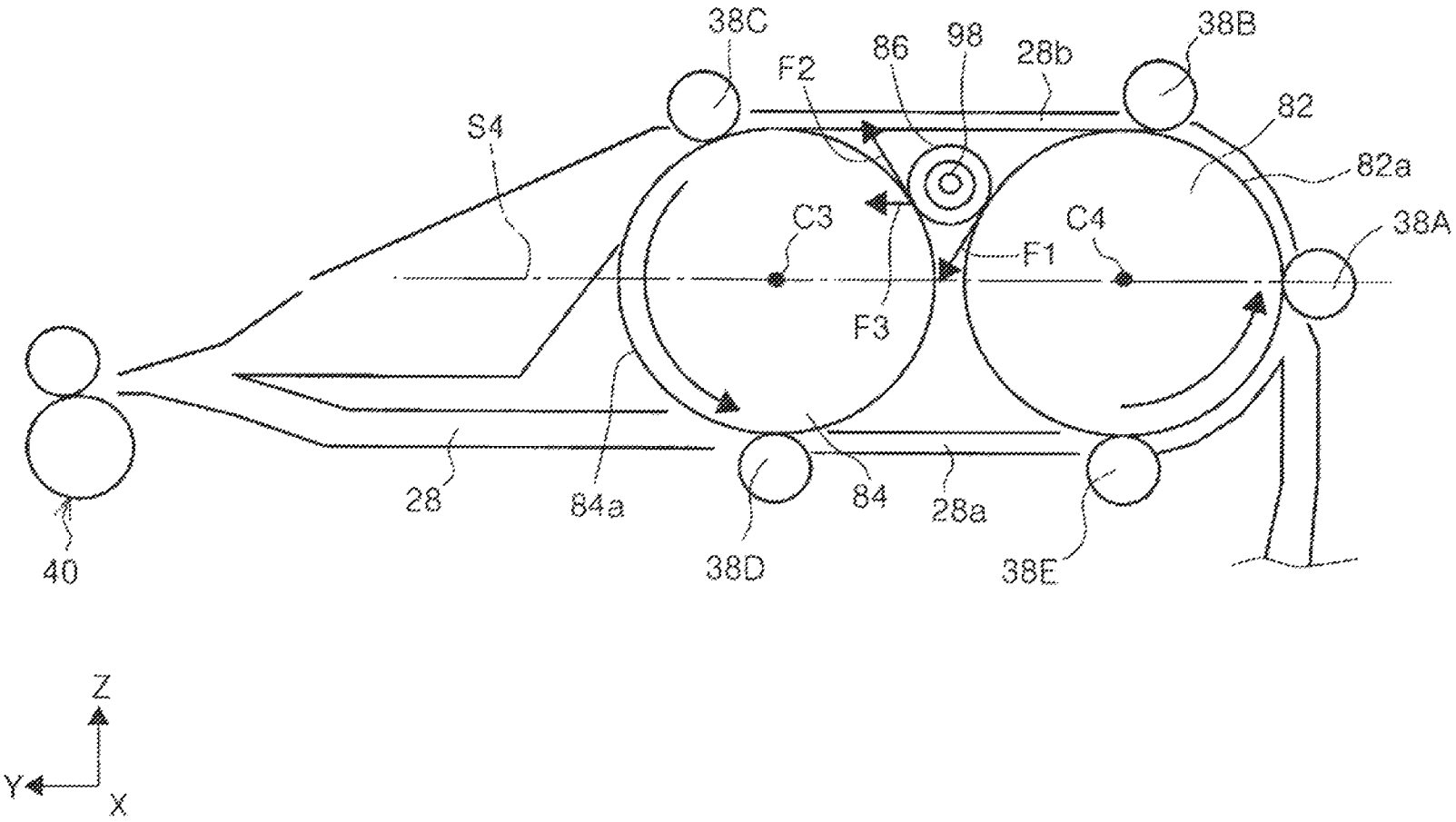
FIG. 18 is a schematic view illustrating a positional relationship between the feeding roller, the inverting roller, and the cleaning roller according to the second embodiment.

In FIG. 18, the cleaning roller 86 is disposed on the post-inversion path 28*b* side with respect to an imaginary line S4 connecting a rotation center C3 of the feeding roller 84 and a rotation center C4 of the inverting roller 82 to each other. The cleaning roller 86 is disposed between the inverting roller 82 and the feeding roller 84 on the side of the post-inversion path 28*b* with respect to the imaginary line S4, and is in contact with an outer circumferential surface 82*a* of the inverting roller 82 and an outer circumferential surface 84*a* of the feeding roller 84.

In the present embodiment, the rotation shaft 98 is configured to be displaced along the grooves 80*b* in the Z-axis direction, that is, in directions in which it is moved toward and away from both the inverting roller 82 and the feeding roller 84. Specifically, in FIG. 18, the rotation shaft 98 and the cleaning roller 86 are displaceable in the Z-axis direction. Thereby, the position of the cleaning roller 86 can be adjusted with respect to the inverting roller 82 and the feeding roller 84. As a result, even when the cleaning roller 86 changes in diameter due to aging or wear, the position of the cleaning roller 86 with respect to the inverting roller 82 and the feeding roller 84 can be adjusted and the cleaning performance can be maintained.

In FIG. 18, the dead weight of the cleaning roller 86 acts on the cleaning roller 86 in the −Z-axis direction between the inverting roller 82 and the feeding roller 84. Therefore, the position of the cleaning roller 86 with respect to the inverting roller 82 and the feeding roller 84 can be adjusted with a simple configuration and the cleaning performance can be maintained.

Here, when the inverting roller 82 and the feeding roller 84 rotate in the counterclockwise direction in FIG. 18, the cleaning roller 86 receives a force F1 from the inverting roller 82.

On the other hand, the cleaning roller 86 receives a force F2 from the feeding roller 84. Therefore, a combined force F3 of the force F1 and the force F2 acts on the cleaning roller 86. The resultant force F3 acts to press the cleaning roller 86 against the outer circumferential surface 84*a* of the feeding roller 84. As a result, the cleaning roller 86 becomes in close contact with the outer circumferential surface 84*a* of the feeding roller 84 and the ink adhering to the outer circumferential surface 84*a* can be reliably absorbed.

Modification of Second Embodiment

Figure 19:
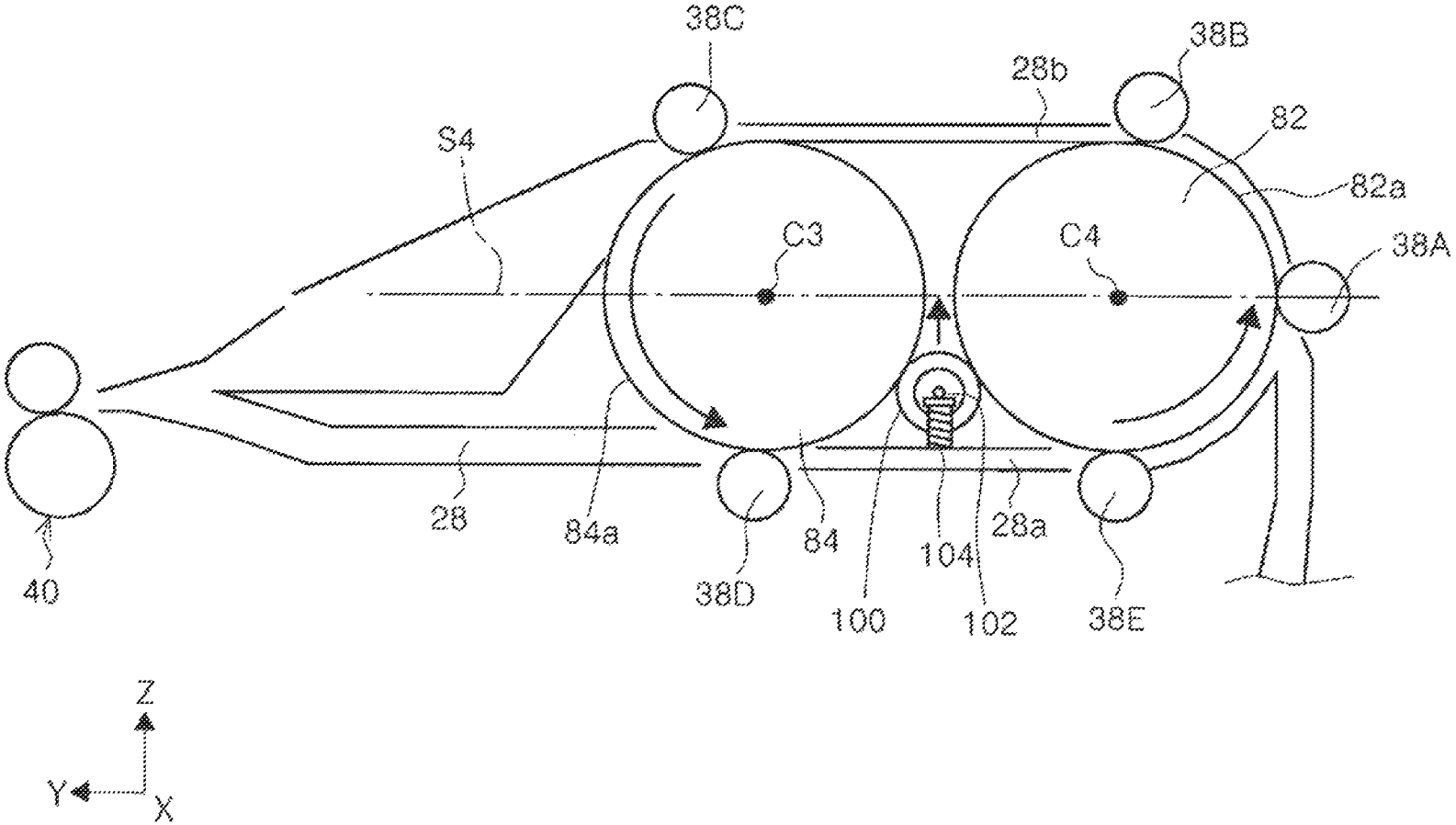
FIG. 19 is a schematic view illustrating a modification of the second embodiment.

In addition, in this embodiment, the cleaning roller 86 is disposed on the post-inversion path 28*b* side with respect to the imaginary line S4, but instead of this configuration, a cleaning roller 100 may be disposed on the pre-inversion path 28*a* side as illustrated in FIG. 19. In this configuration, because the cleaning roller 100 is displaced in a direction away from the inverting roller 82 and the feeding roller 84 by its dead weight, a pressing member 104 is provided to press a rotation shaft 102 of the cleaning roller 100 in the +Z axis direction. The cleaning roller 100 is pressed against the outer circumferential surface 82*a* of the inverting roller 82 and the outer circumferential surface 84*a* of the feeding roller 84 by the pressing member 104. Thus, the cleaning roller 100 can reliably absorb the ink attached to the outer circumferential surface 82*a* of the inverting roller 82 and the outer circumferential surface 84*a* of the feeding roller 84. In this modification, the pressing member 104 is, for example, a coil spring.

In the embodiment, even though the first cleaning roller 52, the second cleaning roller 54, the cleaning belt 70, the cleaning member 74, and the cleaning rollers 78, 86, and 100 according to the present disclosure are applied to an ink jet printer as an example of a recording device, these elements are also applicable to other liquid ejecting apparatuses in general.

Here, a liquid ejecting apparatus uses an ink jet type recording head, is not limited to a recording device such as a printer that performs recording on a recording medium by discharging ink from a recording head, a photocopier or a facsimile machine, and may be a device that attaches a liquid to a target ejecting medium by ejecting, instead of ink, a liquid corresponding to the purpose to the target ejecting medium corresponding to the target recording medium from a liquid ejecting head corresponding to the ink jet type recording head.

Examples of a liquid ejecting head other than the recording head include a color material ejecting head used for the manufacture of color filters such as those of liquid crystal displays, an ejecting head used for ejecting electrode materials (conductive paste) used for the formation of electrodes such as those of an organic electroluminescence (EL) display or a field effect display (FED), a bioorganic substance ejecting head used in the manufacture of biochips, and a sample ejecting head as a precision pipette.

Furthermore, the disclosure is not limited to the above described embodiments, and it goes without saying that it is possible to make various modifications within the scope of the disclosure described in the claims and that these are included in the scope of the disclosure.

What is claimed is:

1. A recording device comprising:

a recording unit that records on a medium;

an inverting path that inverts the medium sent from the recording unit and sends the inverted medium back to the recording unit;

a feeding roller an outer circumferential surface of which applies a transporting force to the medium both at a first position in the inverting path before inverting the medium and at a second position in the inverting path after inverting the medium, the inverting path including an inverting roller that inverts the medium, to which a transporting force is applied by the feeding roller at the first position, toward the second position; and a cleaning unit that cleans the outer circumferential surface of the feeding roller by coming into contact with the outer circumferential surface of the feeding roller; wherein:

the cleaning unit, when a transport path is seen in side view, is disposed in a space between the feeding roller and the inverting roller, the cleaning unit includes the first cleaning unit, and a second cleaning unit that cleans an outer circumferential surface of the inverting roller, the cleaning unit, before a contact portion on the outer circumferential surface of the feeding roller in contact with the medium at the first position reaches the second position with rotation of the feeding roller, is disposed at a position in contact with the contact portion, and when the medium transport path is seen in side view, with respect to an imaginary line connecting a rotation center of the feeding roller and a rotation center of the inverting roller, the first cleaning unit is disposed on a first side of the imaginary line, and the second cleaning unit is disposed on a second side opposite to the first side across the imaginary line.

2. The recording device according to claim 1, wherein the cleaning unit is provided in a region along the outer circumferential surface of the feeding roller and is in contact with the contact portion between an intermediate position, which is between the first position and the second position, and the first position.

3. The recording device according to claim 1, wherein the cleaning unit is pressed against the outer circumferential surface of the feeding roller by a pressing member.

4. The recording device according to claim 1, wherein the cleaning unit, when the medium transport path is seen in side view, is disposed in a space between a first tangential line, which is a common tangential line between a position on the outer circumferential surface of the feeding roller facing the first position and an outer circumferential surface of the inverting roller, and a second tangential line, which is a common tangential line between a position on the outer circumferential surface of the feeding roller facing the second position and the outer circumferential surface of the inverting roller.

5. The recording device according to claim 1, wherein the cleaning unit is in contact with an outer circumferential surface of the inverting roller in addition to the outer circumferential surface of the feeding roller and cleans the outer circumferential surface of the inverting roller.

6. The recording device according to claim 1, wherein the cleaning unit is configured to be displaced in directions in which the cleaning unit comes in and out of contact with the feeding roller and the inverting roller.

7. The recording device according to claim 1, wherein the cleaning unit, when the medium transport path is seen in side view, with respect to an imaginary line connecting a rotation center of the feeding roller and a rotation center of the inverting roller, is disposed on a side of the inverting path after inverting the medium.

8. The recording device according to claim 1, wherein the cleaning unit, when the medium transport path is seen in side view, with respect to an imaginary line connecting a rotation center of the feeding roller and a rotation center of the inverting roller, is disposed on a side of the inverting path before inverting the medium.

9. The recording device according to claim 1, wherein the feeding roller, the inverting roller, and the cleaning unit constitute a unit body configured to attach to and detach from a casing including the recording unit.

10. The recording device according to claim 1, wherein the cleaning unit is a roller member.

11. The recording device according to claim 1, wherein the cleaning unit is a belt-like member.

* * * * *